US012618402B2

(12) United States Patent
Zulauf et al.

(10) Patent No.: US 12,618,402 B2
(45) Date of Patent: May 5, 2026

(54) PUMP ASSEMBLY

(71) Applicant: Leggett & Platt Canada Co., Halifax (CA)

(72) Inventors: Krzysztof Zulauf, Windsor (CA); Maxime Samain, Harelbeke (BE); Eric Michalak, Canton, MI (US); Robert J. McMillen, Tecumseh (CA); Wade O'Moore, Belle River (CA); Horia Blendea, LaSalle (CA); Paul Tindall, Harrow (CA); Stefano Nicola, Windsor (CA)

(73) Assignee: Leggett & Platt Canada Co., Halifax (CA)

( * ) Notice: Subject to any disclaimer, the term of this patent is extended or adjusted under 35 U.S.C. 154(b) by 735 days.

(21) Appl. No.: 17/757,202

(22) PCT Filed: Dec. 11, 2020

(86) PCT No.: PCT/CA2020/000138
§ 371 (c)(1),
(2) Date: Jun. 10, 2022

(87) PCT Pub. No.: WO2021/113950
PCT Pub. Date: Jun. 17, 2021

(65) Prior Publication Data

US 2023/0003210 A1 Jan. 5, 2023

Related U.S. Application Data

(60) Provisional application No. 62/946,907, filed on Dec. 11, 2019.

(51) Int. Cl.
*F04B 45/04* (2006.01)
*F04B 53/00* (2006.01)

(52) U.S. Cl.
CPC ..... *F04B 45/043* (2013.01); *F04B 53/006* (2013.01)

(58) Field of Classification Search
CPC .... F04B 1/00; F04B 1/04; F04B 1/053; F04B 9/04; F04B 9/042; F04B 43/023;
(Continued)

(56) References Cited

U.S. PATENT DOCUMENTS 4,381,180 A 4/1983 Sell
4,386,888 A 6/1983 Verley
(Continued)

FOREIGN PATENT DOCUMENTS

AU 671506 B 8/1996
CA 1163860 A 3/1984
(Continued)

OTHER PUBLICATIONS

Chinese Patent Office Second Office Action for Application No. 202080085852.9 dated May 7, 2024 (16 pages including English translation).
(Continued)

*Primary Examiner* — Essama Omgba
*Assistant Examiner* — Chirag Jariwala
(74) *Attorney, Agent, or Firm* — Michael Best & Friedrich LLP

(57) ABSTRACT

A pump assembly includes a housing with an air inlet and an air outlet, a motor supported by the housing, the motor including a drive shaft rotatable about a drive shaft axis, a first plurality of diaphragms supported by the housing, the first plurality of diaphragms positioned along a first plane, and a second plurality of diaphragms supported by the housing, the second plurality diaphragms positioned along a second plane, the second plane spaced apart from the first plane. Rotation of the drive shaft is operable to move each
(Continued)

diaphragm of the first plurality of diaphragms and each diaphragm of the second plurality of diaphragms from an intake position to a compression position to pump a fluid from the air inlet through the air outlet.

20 Claims, 17 Drawing Sheets

(58) Field of Classification Search
CPC ..... F04B 43/025; F04B 43/026; F04B 43/04; F04B 43/043; F04B 53/006; F04B 45/041; F04B 45/043; F04B 43/02; F04B 43/028; F04B 45/04; F04B 45/045
See application file for complete search history.

(56) References Cited

U.S. PATENT DOCUMENTS

| | | | | |
|---|---|---|---|---|
| 4,566,867 | A | 1/1986 | Bazan et al. | |
| 4,634,350 | A | 1/1987 | Credle, Jr. | |
| 4,708,601 | A | 11/1987 | Bazan et al. | |
| 5,222,876 | A | 6/1993 | Budde | |
| 5,232,352 | A | 8/1993 | Robinson | |
| 5,332,372 | A | 7/1994 | Reynolds | |
| 5,334,003 | A | 8/1994 | Gardner et al. | |
| 5,368,452 | A | 11/1994 | Johnson et al. | |
| 6,148,716 | A | 11/2000 | Swank | |
| 6,474,961 | B1 | 11/2002 | Timmer et al. | |
| 6,561,774 | B2 | 5/2003 | Layman | |
| RE38,239 | E | 8/2003 | Duncan | |
| 6,901,960 | B2 | 6/2005 | Roberts et al. | |
| 7,527,483 | B1 | 5/2009 | Glauber | |
| 9,028,224 | B2 | 5/2015 | Headley et al. | |
| 9,624,918 | B2 * | 4/2017 | Goertzen et al. | F04B 25/00 |
| 9,663,009 | B2 | 5/2017 | Arashi | |
| 2004/0047748 | A1 | 3/2004 | Roberts et al. | |
| 2005/0271525 | A1 * | 12/2005 | Muramatsu et al. | F04B 43/0054 417/413.1 |
| 2008/0315636 | A1 | 12/2008 | Yetukuri et al. | |
| 2009/0304532 | A1 | 12/2009 | Tabanelli et al. | |
| 2010/0045096 | A1 | 2/2010 | Schonlau et al. | |
| 2010/0183462 | A1 * | 7/2010 | Kaufmann et al. | F04B 53/14 417/473 |
| 2011/0038740 | A1 * | 2/2011 | Goertzen et al. | F04B 27/0414 417/273 |
| 2011/0132190 | A1 | 6/2011 | Koch | |
| 2013/0098328 | A1 * | 4/2013 | Hofbauer | F01B 7/08 123/192.2 |
| 2014/0339009 | A1 | 11/2014 | Suzuki et al. | |
| 2018/0306170 | A1 * | 10/2018 | Ottosen et al. | F04B 43/04 |
| 2020/0031420 | A1 | 1/2020 | Aunkst et al. | |
| 2022/0203816 | A1 | 6/2022 | Lu et al. | |

FOREIGN PATENT DOCUMENTS

| | | | | |
|---|---|---|---|---|
| CA | 1234720 | A | 4/1988 | |
| CA | 2439670 | C | 3/2011 | |
| CN | 2260180 | Y | 8/1997 | |
| CN | 101418786 | A * | 4/2009 | F04B 45/047 |
| CN | 103147965 | A | 6/2013 | |
| CN | 202971083 | U | 6/2013 | |
| CN | 104976106 | A | 10/2015 | |
| CN | 207261223 | U | 4/2018 | |
| DE | 19904350 | A1 | 8/2000 | |
| EP | 0172367 | B2 | 3/1993 | |
| EP | 0458000 | B1 | 10/1993 | |
| EP | 0609044 | A1 | 8/1994 | |
| EP | 1936187 | A1 | 6/2008 | |
| EP | 1396637 | B1 | 6/2011 | |
| EP | 2573395 | A2 | 3/2013 | |
| EP | 2365220 | B1 | 8/2017 | |
| GB | 2085979 | B | 6/1984 | |
| GB | 2301151 | A * | 11/1996 | F04B 45/04 |
| GB | 2357811 | A | 7/2001 | |
| GB | 2565911 | A | 2/2019 | |
| JP | H08338370 | A | 12/1996 | |
| WO | 2009044260 | A1 | 4/2009 | |
| WO | 2009103217 | A1 | 8/2009 | |

OTHER PUBLICATIONS

International Search Report and Written Opinion for Application No. PCT/CA2020/000138, dated Apr. 5, 2021 (10 bages).
International Preliminary Report on Patentability for Application No. PCT/CA2020/000138 dated Jun. 23, 2022 (8 pages).
European Patent Office, Extended European Search Report for application 20898006.0, dated Dec. 19, 2023 (7 pages).
Chinese Patent Office First Office Action for Application No. 202080085852.9, dated Nov. 23, 2023 (23 pages with translation).
European Patent Office Extended Search Report for Application No. 24165138.9 dated Sep. 3, 2024 (9 pages).
European Patent Office Action for application 20898006.0 dated Mar. 14, 2025 (5 pages).

* cited by examiner

PUMP ASSEMBLY

CROSS-REFERENCE TO RELATED APPLICATIONS

This application is a national phase of International Patent Application No. PCT/CA2020/000138, filed on Dec. 11, 2020, which claims priority to U.S. Provisional Patent Application No. 62/946,907, filed Dec. 11, 2019, the entire content of which is incorporated herein by reference.

FIELD

The present disclosure relates to pneumatic pumps and more particularly to diaphragm pumps.

BACKGROUND

In many industries, such as comfort, aerospace, automotive, and furniture, there is a need for an effective way to generate air pressure to power pneumatic devices, such as lumbar supports, massage assemblies, and the like. One way to generate air pressure is a diaphragm pump. A diaphragm pump is a positive displacement pump that uses a combination of the reciprocating action of a flexible diaphragm and one-way valves to pump a fluid.

SUMMARY

The present disclosure provides, in one aspect, a pump assembly including a housing with an air inlet and an air outlet, a motor supported by the housing, the motor including a drive shaft rotatable about a drive shaft axis, a first plurality of diaphragms supported by the housing, the first plurality of diaphragms positioned along a first plane, and a second plurality of diaphragms supported by the housing, the second plurality diaphragms positioned along a second plane, the second plane spaced apart from the first plane. Rotation of the drive shaft is operable to move each diaphragm of the first plurality of diaphragms and each diaphragm of the second plurality of diaphragms from an intake position to a compression position to pump a fluid from the air inlet through the air outlet.

The present disclosure provides, in another aspect, a pump assembly including a housing having an air inlet and an air outlet, a motor supported by the housing, the motor including a drive shaft rotatable about a drive shaft axis, a first diaphragm supported by the housing, the first diaphragm defining a first plane, a second diaphragm supported by the housing, the second diaphragm defining a second plane, the second plane spaced apart from the first plane, a crankshaft coupled to the drive shaft for co-rotation with the drive shaft about the drive shaft axis, a first connecting rod coupled to the crankshaft and to the first diaphragm, the first connecting rod configured to reciprocate along a first connecting rod axis in response to rotation of the crankshaft to move the first diaphragm between an intake position and a compression position, and a second connecting rod coupled to the crankshaft and to the second diaphragm, the second connecting rod configured to reciprocate along a second connecting rod axis in response to rotation of the crankshaft to move the second diaphragm between and intake position and a compression position.

The present disclosure provides, in another aspect, a pump assembly including a housing with an air inlet and an air outlet, a motor supported by the housing, the motor including a drive shaft rotatable about a drive shaft axis, a first plurality of diaphragms supported by the housing, the first plurality of diaphragms positioned along a first plane, and a second plurality of diaphragms supported by the housing, the second plurality diaphragms positioned along a second plane. The second plane is spaced apart from the first plane. Rotation of the drive shaft is operable to move each diaphragm of the first plurality of diaphragms and each diaphragm of the second plurality of diaphragms from an intake position to a compression position to pump a fluid from the air inlet through the air outlet. Movement of the first plurality of diaphragms and the second plurality of diaphragms produces four air pulses through the air outlet per revolution of the drive shaft.

Other aspects of the disclosure will become apparent by consideration of the detailed description and accompanying drawings.

Before any embodiments of the disclosure are explained in detail, it is to be understood that the disclosure is not limited in its application to the details of construction and the arrangement of components set forth in the following description or illustrated in the following drawings. The disclosure is capable of supporting other embodiments and of being practiced or of being carried out in various ways. Also, it is to be understood that the phraseology and terminology used herein is for the purpose of description and should not be regarded as limiting. In addition, as used herein, the terms "upper", "lower", and other directional terms are not intended to require any particular orientation, but are instead used for purposes of description only.

DETAILED DESCRIPTION

Figure 1:
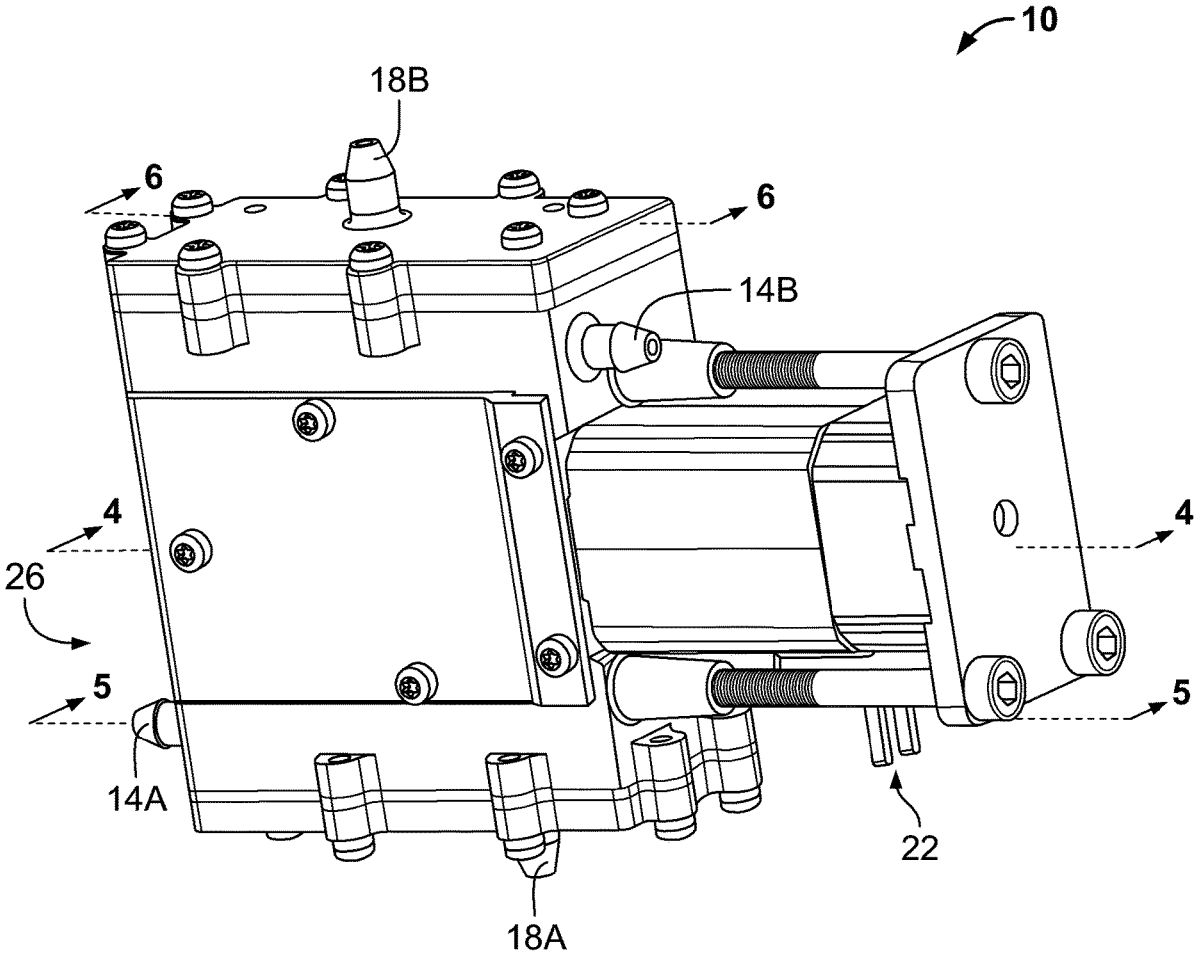
FIG. 1 is a perspective view of a pump assembly according to an embodiment of the present disclosure.

FIG. 1 illustrates a pump assembly 10 according to one embodiment of the invention. The pump assembly 10 is configured for providing pressurized/compressed air for use in a downstream application. Such air may be provided to the pump assembly 10 through air inlets (e.g., a first air inlet 14A and a second air inlet 14B) and may be discharged through air outlets (e.g., a first air outlet 18A and a second air outlet 18B). In other embodiments, the pump assembly 10 may include any number or arrangement of air inlets and air outlets. The pump assembly 10 may be powered by any suitable power source, including AC or DC power sources. In the illustrated embodiment, the pump assembly 10 includes an electrical connector 22 for receiving power from the power source.

Figure 2:
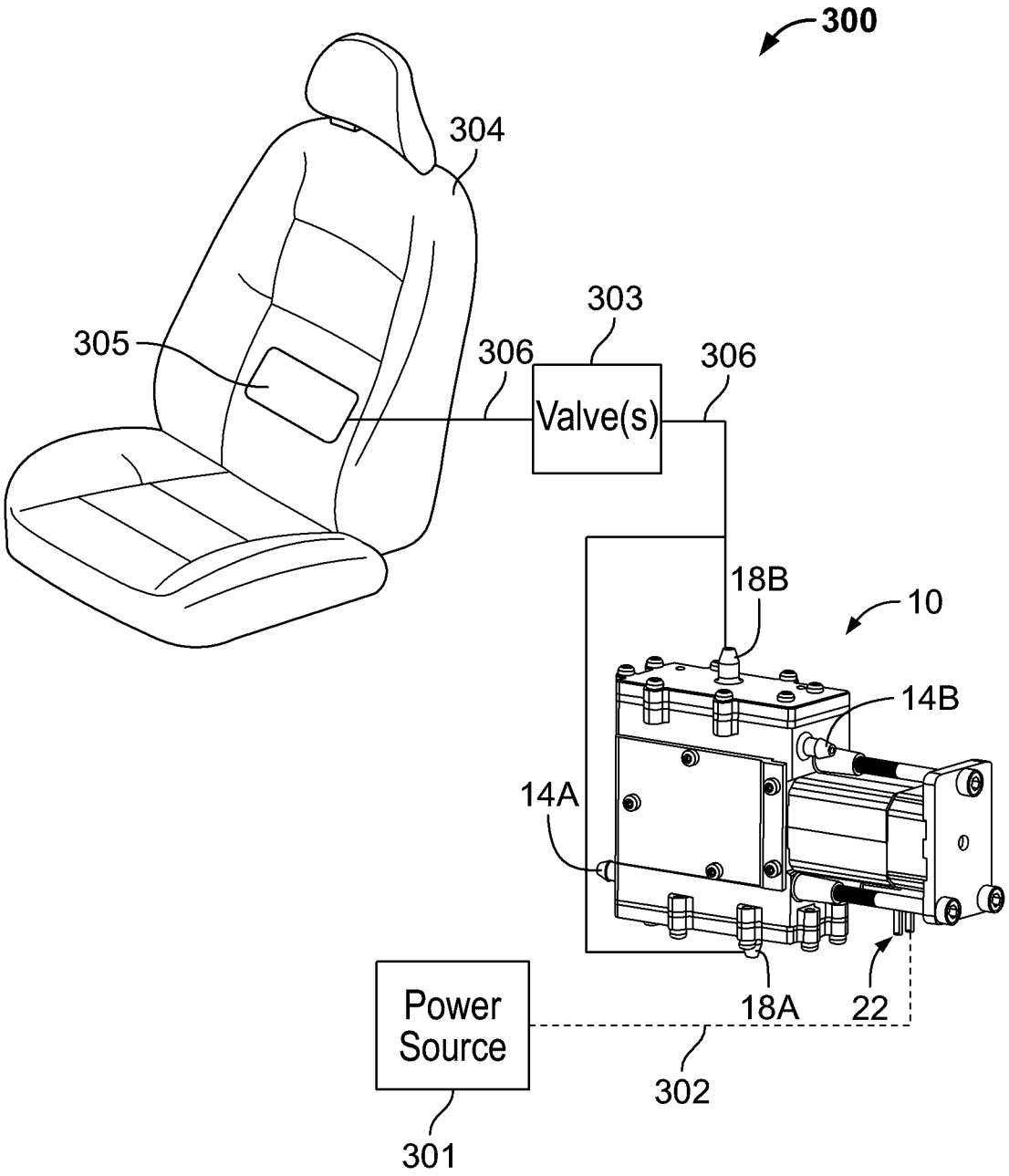
FIG. 2 is a schematic illustration of a pneumatic system according to the present disclosure, including the pump assembly of FIG. 1.

FIG. 2 illustrates an embodiment of a pneumatic system 300 including the pump assembly 10. The pneumatic system 300 may be a portion of an automobile. For example, in the illustrated embodiment, the pneumatic system 300 is part of an automobile seating assembly. Other applications of the pneumatic system 300 are contemplated, however, such as aerospace applications, office/desk chair applications, or the like.

In the illustrated embodiment, the pneumatic system 300 includes a power source 301, which may be part of an electrical power system of an automobile. The connector 22 is configured to connect to the power source 301. As such, the power source 301 may supply power 302 (e.g., DC power at 12 Volts, 24 Volts, or 28 Volts in some embodiments) to the pump assembly 10 via the connector 27.

When the pump assembly 10 is powered, the pump assembly 10 may operate to pump air from the atmosphere into the pump assembly 10 through the air inlets 14A, 14B and then pump the air out through the of 18A, 18B. For example, air may flow from the outlets 18A, 18B through a pneumatic line 306. In some embodiments, the pump assembly 10 may include a single outlet and/or a single air inlet.

The pneumatic line 306 may include one or more valves 303 along or at either end of the pneumatic line 306. The valves 303 may be a single valve and/or may be multiple valves, and in either case may serve to: (i) direct air along the pneumatic line 306 from the pump assembly 10, (ii) stop a flow of air along the pneumatic line 306 directed from the pump assembly 10, (iii) regulate pressure of a flow of air through the pneumatic line 306, and/or (iv) regulate flow rate of a flow of air through the pneumatic line 306. For example, the valves 303 may include one or more check valves, pressure relief valves, flow-regulating valves, or the like. Additionally or alternatively, the valves 303 may include a release valve, which may allow air to vent from the pneumatic line 306 to the atmosphere or into another, connected pneumatic line. The valves 303 may be passive valves or active valves in some embodiments. In some embodiments, the valves 303 may be incorporated into the pump assembly 10 as an integrated assembly.

The pneumatic line 306 may be connected to one or more bladders 305. In such embodiments, the valves 303 or a controller may be used to direct the air through the pneumatic line 306 to a specific bladder 305. The bladder 305 may be configured to expand or contract as air from the pneumatic line 306 flows into or is removed from the bladder 305. In some embodiments, the bladder 305 may be supported in a bladder supporting device 304, which may be any of a variety of devices for use in different applications. For example, in some embodiments, the bladder supporting device 304 may be an automotive seat configured to be positioned within an automobile. In some embodiments, the bladder 305 may be positioned within the bladder supporting device 304 to provide lumbar support when a user sits against the bladder supporting device 304. In such an embodiment, the user may provide a request for increasing or decreasing lumbar support (e.g., the user may press a button) which may activate the pump assembly 10 to provide air from the pump assembly 10, through the pneumatic line 306, and into the bladder 305 positioned within the bladder supporting device 304, thereby inflating the bladder 305 and providing the requested lumber support. In some embodiments, the bladder supporting device 304 may support multiple bladders 305.

Figure 3:
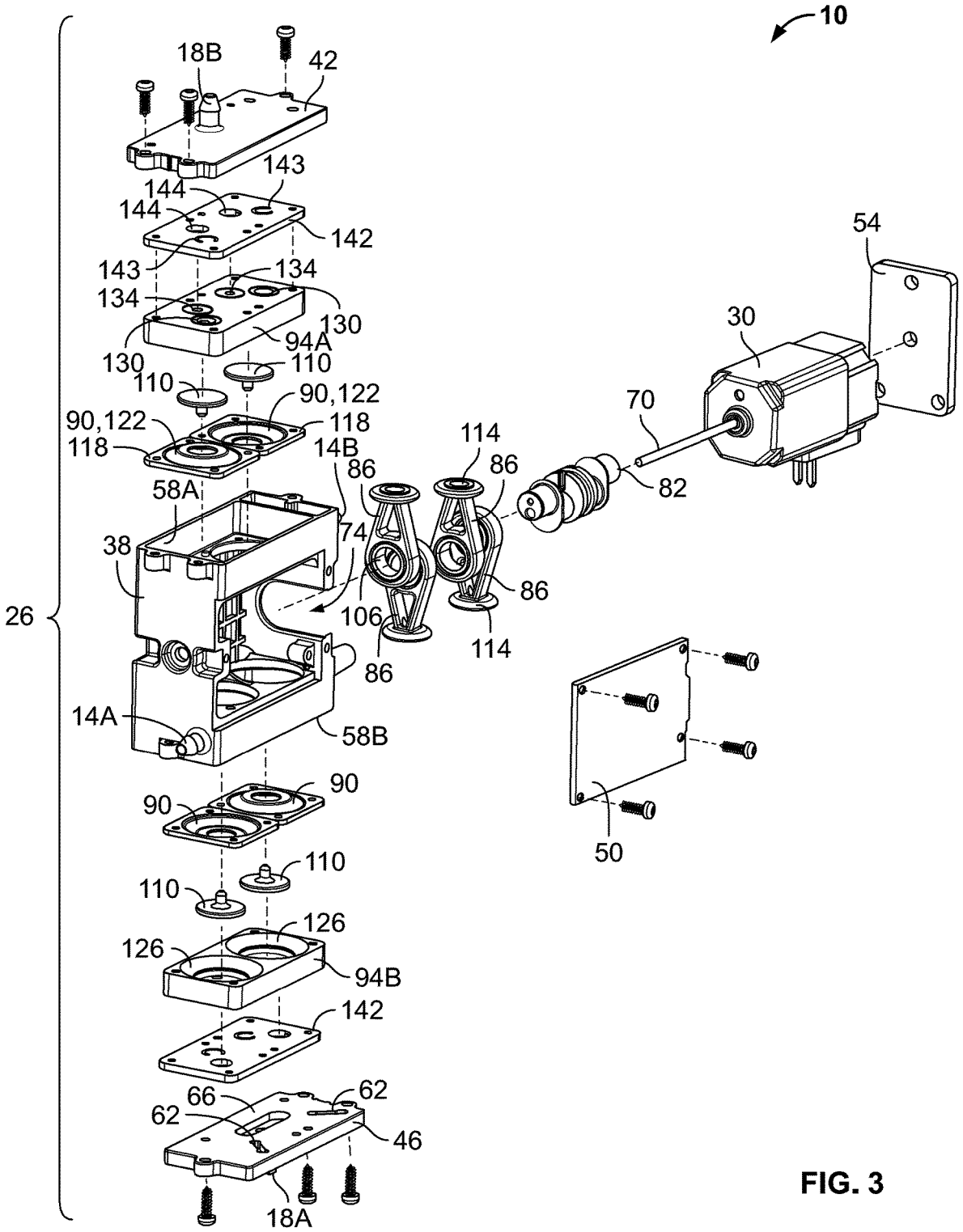
FIG. 3 is an exploded view of the pump assembly of FIG. 1.
Figure 4:
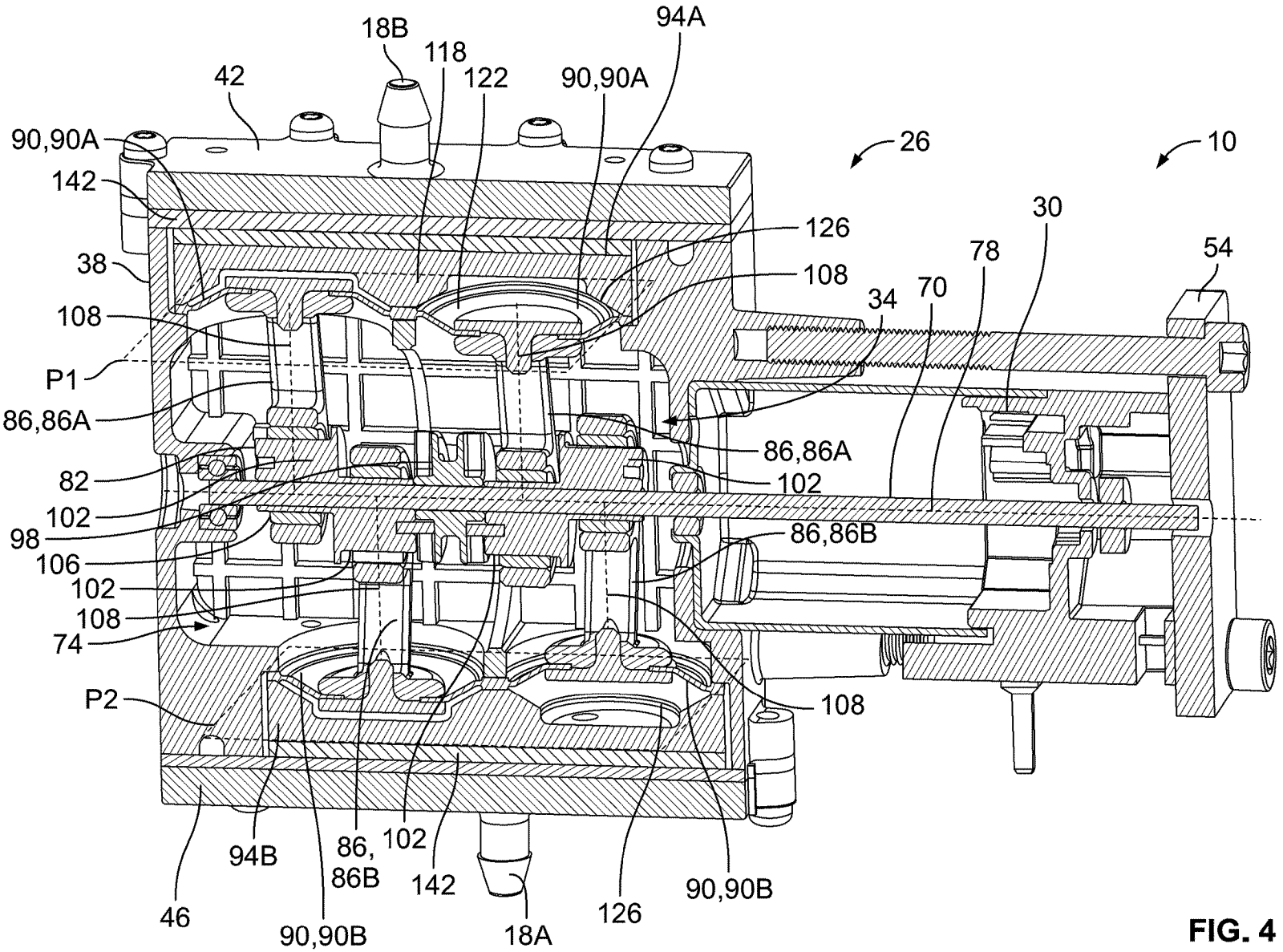
FIG. 4 is a perspective cross-sectional view of the pump assembly of FIG. 1 taken across line 4-4.

With reference to FIG. 3, the pump assembly 10 includes a housing 26, a motor 30, and a pump drive mechanism 34 (FIG. 4). The housing 26 includes a main housing 38, an upper cover 42, a lower cover 46, one or more side covers 50, and a motor bracket 54.

The main housing 38 includes the first and second air inlets 14A, 14B. In the illustrated embodiment, the air inlets 14A, 14B are on diametrically opposite sides of the housing from one another. In addition, the first air inlet 14A is positioned adjacent a lower side of the housing 26 or adjacent the lower cover 46, and the second air inlet 14B is positioned adjacent an upper side of the housing 26 or adjacent the upper cover 42. As will be described in more detail below, the first and second air inlets 14A, 14B define air passageways into the housing 26. The main housing 38 further includes upper and lower receptacles 58A, 58B to receive portions of the pump drive mechanism 34 (FIG. 4).

In the illustrated embodiment, the lower cover 46 includes the first air outlet 18A and the upper cover 42 includes the second air outlet 18B. The first and second air outlets 18A, 18B are configured as fittings in the illustrated embodiment (e.g., barb fittings), to facilitate connection to a flexible tubes or other pneumatic lines.

The upper and lower covers 42, 46 may include air passageways. For example, the upper and lower covers 42, 46 each include air intake passageways 62 and an air outlet passageway 66 (visible on the lower cover 46 in FIG. 3 and on the upper cover 42 in FIG. 5). The air outlet passageways 66 of the covers 42, 46 are in fluid communication with the respective air outlets 18A, 18B.

With continued reference to FIG. 3, the components of the housing 26 may be coupled together in various ways. For example, the upper and lower covers 42, 46 may be fastened to the main housing 38 with fasteners to secure components of the pump drive mechanism 34 within the upper and lower receptacles 58A, 58B. Alternatively, the upper and lower covers 42, 46 may be laser-welded, ultrasonically-welded, or otherwise bonded to the main housing 38. In the illustrated embodiment, the side cover 50 is removably coupled to the side of the housing 26 with fasteners, a snap fit, or the like. The side cover 50 may be removed from the housing 26 to repair or maintain components of the pump drive mechanism 34. The removable side cover 50 may also facilitate assembly of the drive mechanism 34 into an interior volume 74 of the housing 26. In some embodiments, the housing 26 may include multiple removable side covers (e.g., positioned on opposite sides of the housing 26 or in other arrangements).

The motor bracket 54 secures the motor 30 to the main housing 38 (FIGS. 1 and 2). The motor 30 includes a drive shaft 70 that extends longitudinally through the housing 26. The motor bracket 54 is coupled to the main housing 38 using fasteners in the illustrated embodiment; however, the motor bracket 54 may be integrally formed with the main housing 38 or coupled to the main housing 38 in other ways. Alternatively, the motor 30 may be directly fastened to the main housing 38 such that the motor bracket 54 may be omitted.

The motor 30 may receive power (e.g., from the power source 301) to rotate the drive shaft 70. The drive shaft 70 defines and is rotatable about a longitudinal axis 78 (FIG. 4). In the illustrated embodiment, the motor 30 may be operable to rotate the drive shaft 70 at a speed of at least 5000 revolutions per minute (RPM). In other embodiments, the drive shaft 70 may rotate at other speeds, including speeds less than 5000 RPM With reference to FIGS. 3 and 4, the illustrated pump drive mechanism 34 includes a crank shaft 82, a plurality of connecting rods 86, and a plurality of flexible diaphragms 90 having their outer peripheries fixed between upper and lower chamber blocks 94A, 94B and the main housing 38. The crank shaft 82 is coupled for co-rotation with the drive shaft 70 of the motor 30 such that the motor 30 is operable to rotate the crank shaft 82 about the longitudinal axis 78. In some embodiments, a transmission, one or more intermediate shafts, and/or one or more gear stages may be provided between the drive shaft 70 and the crank shaft 82.

Referring to FIG. 4, the crank shaft 82 may include one or more counterweights 98 and a plurality of journals 102. The number of journals 102 corresponds to the number of connecting rods 86, which in turn corresponds to the number of diaphragms 90. In the illustrated embodiment, the pump drive mechanism 34 includes four connecting rods 86, four diaphragms 90, and four journals 102; however, in other embodiments, the pump drive mechanism 34 may include two, six, eight, or any other number of these components.

Each of the connecting rods 86 is rotatably coupled to a corresponding journal 102 by a bearing 106. The journals 102 are offset from the longitudinal axis 78 such that rotation of the crank shaft 82 causes the connecting rods 86 to reciprocate. In the illustrated embodiment, each of the connecting rods 86 reciprocates along a respective axis 108, and each of the axes 108 is orthogonal to the longitudinal axis 78. Reciprocating of the connecting rods 86 along the axis 108 is not purely linear, as the connecting rods 86 are configured to tilt back and forth across the respective axes 108 as the crank shaft 82 rotates.

The diaphragms 90 are positioned within the upper and lower receptacles 58A, 58B of the housing 26. In the illustrated embodiment, there are four diaphragms 90 (i.e., two positioned in the upper receptacle 58A and two positioned in the lower receptacle 58B). As shown, the diaphragms 90 are separate components from one another. In some embodiments, two adjacent diaphragms 90 may be an integral component. Each diaphragm 90 includes a base 118 surrounding a flexible center portion 122 (FIGS. 3-4). The center portions 122 are configured to move or flex relative to the base 118 between an intake position and a compression position.

With reference to FIGS. 3 and 4, the base 118 of each diaphragm 90 is sandwiched between a respective chamber block 94A, 94B and the main housing 38. The center portion 122 of each of the diaphragms 90 is sandwiched between a connecting flange 110 and a head 114 of an associated connecting rod 86 (FIG. 3). As such, reciprocation of the connecting rods 86 causes the center of each diaphragm 90 to flex relative to the base 118 along the respective axes 108, between the intake position and the compression position (FIG. 4).

With continued reference to FIG. 4, the connecting rods 86 and the diaphragms 90 in the illustrated embodiment are arranged as a first pair 86A, 90A, and a second pair 86B, 90B. The first pair 86A, 90A of connecting rods 86 and diaphragms 90 is configured to reciprocate along parallel axes 108 with the connecting rods 86A extending in a first direction from crank shaft 82, and the second pair 86B, 90B of connecting rods 86 and diaphragms 90 is configured to reciprocate along parallel axes 108 with the connecting rods 86B extending in a second direction from the crank shaft 82 opposite the first direction. That is, the first pair 86A, 90A and the second pair 86B, 90B are positioned on diametrically opposite sides of the axis of rotation 78 or offset from each other by 180 degrees. In other embodiments, the first pair 86A, 90A may be offset 90 degrees about the axis of rotation 78 from the second pair 86B, 90B, or at other angles between about 30 degrees and about 90 degrees in some embodiments, to generally define a "V" configuration.

In yet other embodiments, the connecting rods 86 and diaphragms 90 may not be arranged in pairs. For example, in some embodiments, each of the connecting rods 86 may extend in a different direction from the axis 78, with the connecting rods 86 evenly spaced around a circumferential direction of the drive shaft 70. For example, in embodiments with four diaphragms 90, each of the connecting rods 86 and diaphragms 90 may by offset from adjacent connecting rods 86 and diaphragms 90 by an angle of about 90 degrees. In yet other embodiments, the connecting rods 86 and diaphragms 90 may be arranged in any desired grouping. For example, in embodiments having six diaphragms 90, the connecting rods 86 and diaphragms 90 may be arranged in two groups of three, three groups of two, or all six diaphragms 90 and connecting rods 86 may be oriented in different directions.

With continued reference to FIG. 4, the base 118 of each diaphragm 90 is generally planar. In the illustrated embodiment, the bases 118 of the first pair 90A of diaphragms 90 are generally coplanar and aligned in a first plane P1. The bases 118 of the second pair 90B of diaphragms 90 are also generally coplanar and aligned in a second plane P2. In the illustrated embodiment, the plane P1 is parallel with the plane P2, and the planes P1 and P2 are disposed on opposite sides of the axis 78. In other embodiments, however, the orientations of the planes P1 and P2 may vary. For example, in embodiments in which the diaphragms 90 and connecting rods 86 are disposed in a "V" configuration, the planes P1 and P2 may be orthogonal, or the planes P1 and P2 may intersect at an angle between about 30 degrees and about 90 degrees. Each diaphragm 90 may therefore define a plane that is not coplanar with one or more other diaphragms 90.

Figure 5:
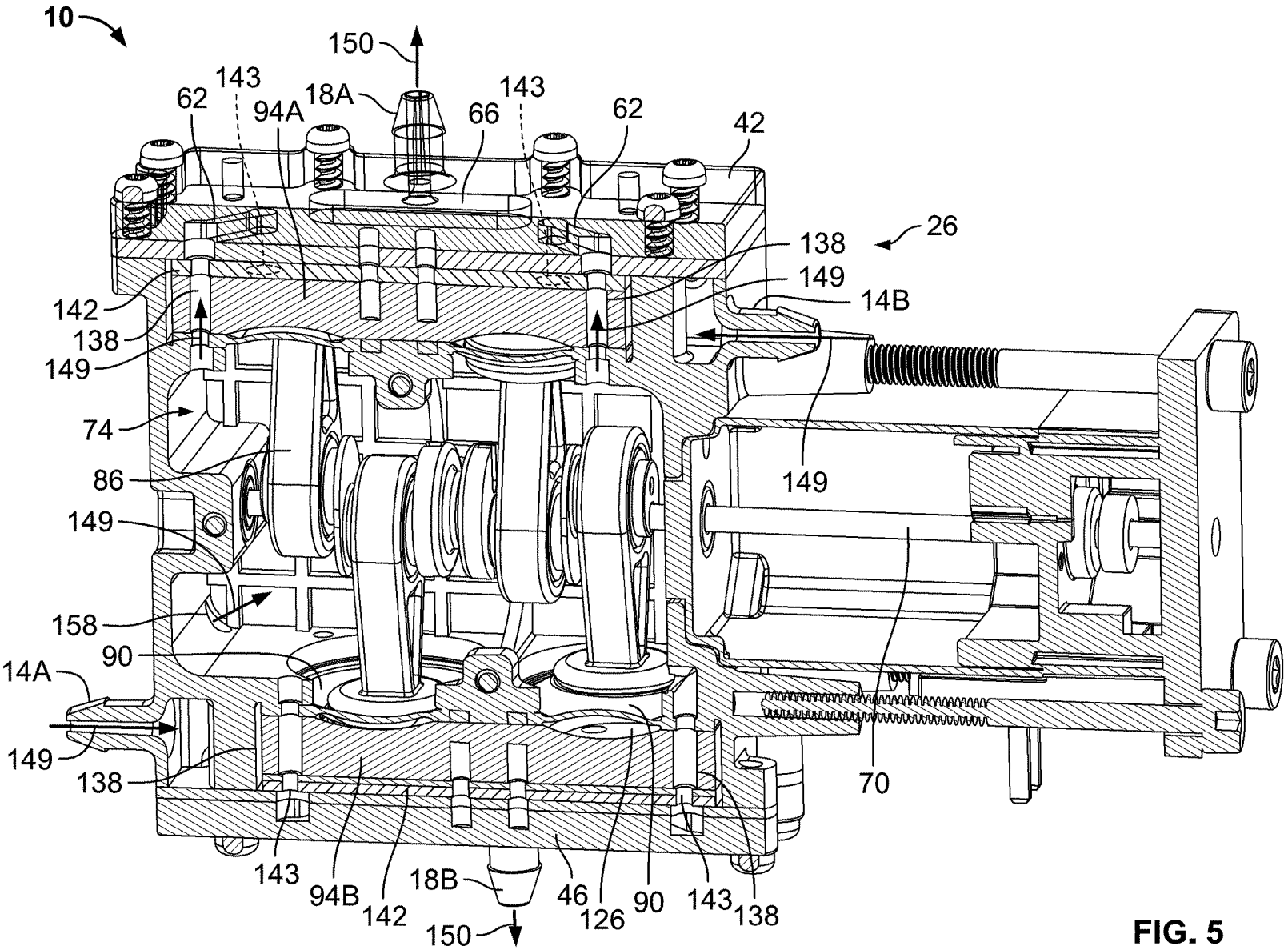
FIG. 5 is a perspective cross-sectional view of the pump assembly of FIG. 1 taken across line 5-5.

Referring to FIG. 3, the upper and lower chamber blocks 94A, 94B are positioned in the upper and lower receptacles 58A, 58B of the housing 26 respectively. An air chamber 126 is defined between the chamber blocks 94A, 94B and each respective diaphragm 90. As such, in the illustrated embodiment, each air chamber block 94 includes two air chambers 126. In other embodiments, each air chamber block 94 may include more than or less than two air chambers 126 to correspond with the number of diaphragms 90. Each air chamber block 94A, 94B also includes two air intake ports 130 and two air outlet ports 134 (FIG. 3), along with two air passageways 138 (FIG. 5).

Figure 6:
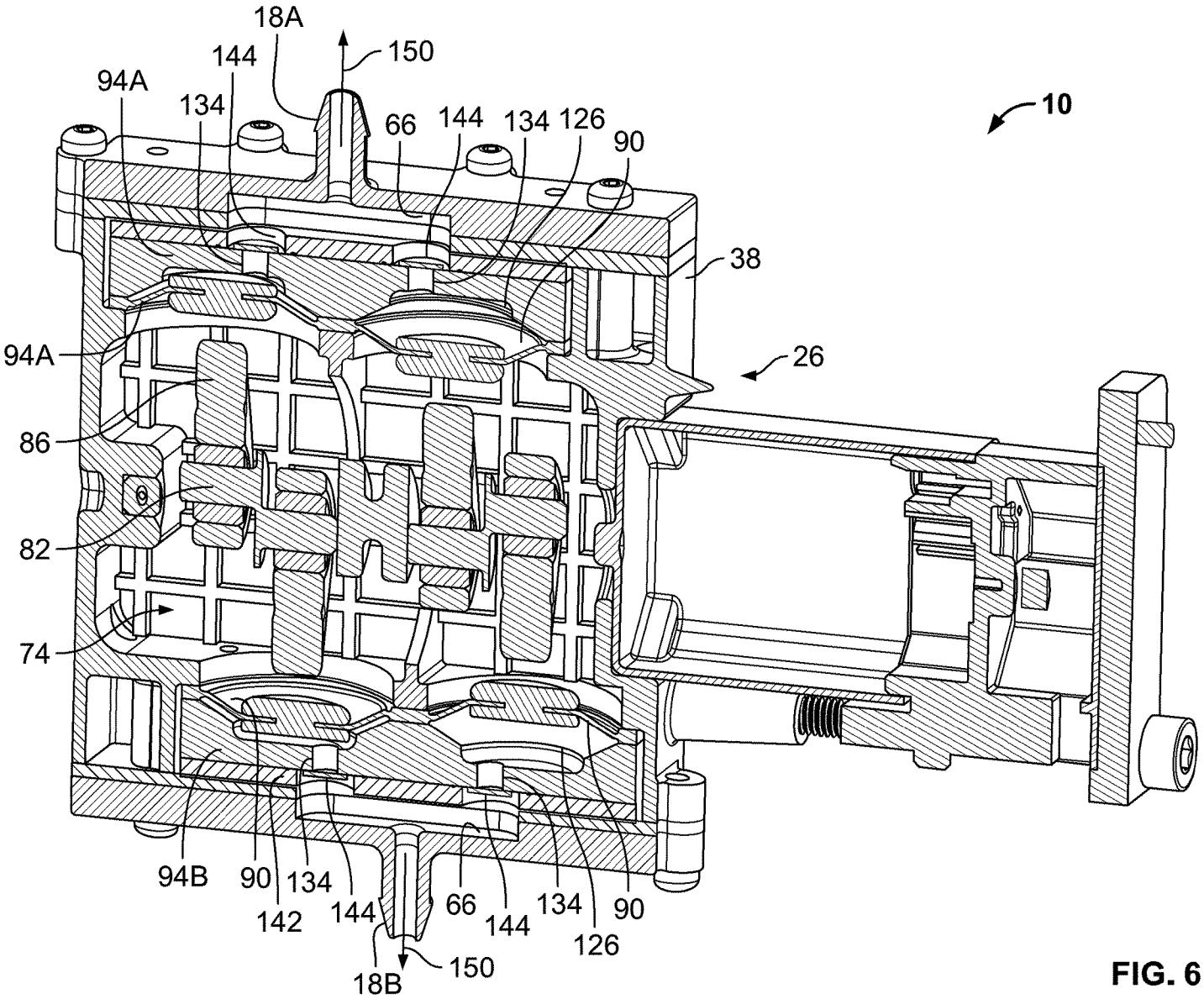
FIG. 6 is another perspective cross-sectional view of the pump assembly of FIG. 1 taken across line 6-6.

A transfer plate 142 is positioned between each air chamber block 94A, 94B and a respective cover 42, 46. The transfer plates 142 includes a plurality of valves that regulate air entering and exiting the air chambers 126. For example, the transfer plates 142 may include two air intake valves 143 (FIG. 5) and two air outlet valves 144 (FIG. 6). In some embodiments, the valves 143, 144 may be one-way valves, such as reed valves, that allow air to only transfer in only one direction. That is, the air intake valves 143 may be configured to allow air to flow into the air chambers 126 in response to negative pressure within the chambers 126, and the air outlet valves 144 may be configured to allow air to flow out of the chambers 126 in response to positive pressure within the chambers 126. In other embodiments, the valves may be any other suitable valve to regulate air exiting and entering the air chambers 126.

During operation of the pump assembly 10, the power source 301 provides power to the motor 30 to rotate the drive shaft 70. The drive shaft 70 rotates the crank shaft 82 about the axis 78, and thus the connecting rods 86 reciprocate along the respective axes 108 (FIG. 4). As the connecting rods 86 reciprocate, the center portions 122 of the diaphragms 90 flex from the intake position to the compression position. Movement of the diaphragms 90 from the intake position to the compression position draws air into the pump assembly 10 and pumps air into the pneumatic line 306 as will be described in more detail below.

As shown in FIG. 4, the diaphragms 90 and connecting rods 86 of the first pair 90A, 86A are 180 degrees out of phase from one another, and the diaphragms 90 and the connecting rods 86 of the second pair 90B, 86B, are likewise 180 degrees out of phase from one another. As such, a first connecting rod 86 and diaphragm 90 of each pair 86A, 90A and 86B, 90B moves to the compression position as a second connecting rod 86 and diaphragm 90 of each pair 86A, 90A and 86B, 90B moves to the intake position. This arrangement, together with the positioning of the pairs 86A, 90A and 86B, 90B on opposite sides of the axis 78, advantageously reduces vibration and noise by effectively cancelling out first and second order forces and moments exerted by the moving connecting rods 86 on the crank shaft 82.

With reference to FIGS. 5-6, movement of each of the diaphragms 90 from the compression position to the intake position (i.e. the intake stroke) creates negative pressure within the respective air chambers 126, which draws air into the housing 26 through the air inlets 14A, 14B along an airflow path 149 (FIG. 5). Movement of each of the diaphragms 90 from the intake position to the compression position (i.e. the pumping stroke) creates positive pressure within the respective air chambers 126, thereby discharging pressurized air out of the housing 26 through the outlets 18A, 18B along an airflow path 150 (FIG. 6).

As shown in FIG. 5, the airflow 149 is drawn in through the air inlets 14A, 14B and then into the interior volume 74 of the main housing 38 through transfer ports 158. By routing the inlet airflow 149 through the housing 26, intake noise may be reduced, and the airflow 149 may remove heat from the pump drive mechanism 34. As the diaphragms 90 continue to move between the intake position and the compression position, the airflow 149 is drawn from the interior volume 74 and into the air passageways 138 of the chamber blocks 94A, 94B. The airflow 149 is then routed through the air intake passageways 62 of the upper and lower covers 42, 46 and drawn into the air chambers 126 through the air intake valves 143 of the transfer plates 142.

Referring to FIG. 6, as the diaphragms 90 are moved from the intake position to the compression position, the airflow 150 is forced through the air outlet ports 134 of the chamber blocks 94A, 94B, through the air outlet valves 144 of the transfer plates 142, and into the air outlet passageways 66 of the upper and lower covers 42, 46. From the air outlet passageways 66, the airflow 150 is directed through the air outlets 18A, 18B and into the pneumatic line 306 where it may be used as described above in reference to the pneumatic system 300.

In the illustrated embodiment, the pump assembly 10 may be operable to pump at least 6 liters of fluid (e.g., air, or other pumpable fluids) per minute. In other embodiments, the pump assembly 10 may produce more than or less than 6 liters of fluid per minute. Additionally, the pump assembly 10 may be operable to produce a pump outlet pressure of at least 70 kPa. In other embodiments, the pump assembly 10 may produce a pump outlet pressure of more than or less than 70 kPa.

The pump assembly 10 described and illustrated herein thus includes multiple diaphragms 90, arranged in at least two planes P1 and P2 that are not co-planar. In the illustrated embodiment, the pump assembly 10 includes multiple diaphragms in each of the planes P1 and P2. The diaphragms 90 are actuated by a central crank shaft 82, which allows the phase of each diaphragm 90 to be independently set to minimize noise and vibration. This arrangement may also provide a relatively high pumping capacity or maximum flow rate, while minimizing the overall size of the pump assembly 10. As such, the pump assembly 10 and variations thereof described and/or illustrated herein may be particularly advantageous for use in applications, (such as automotive, furniture, and aviation applications), in which operating noise, vibration, and package size are of high importance.

Figure 7:
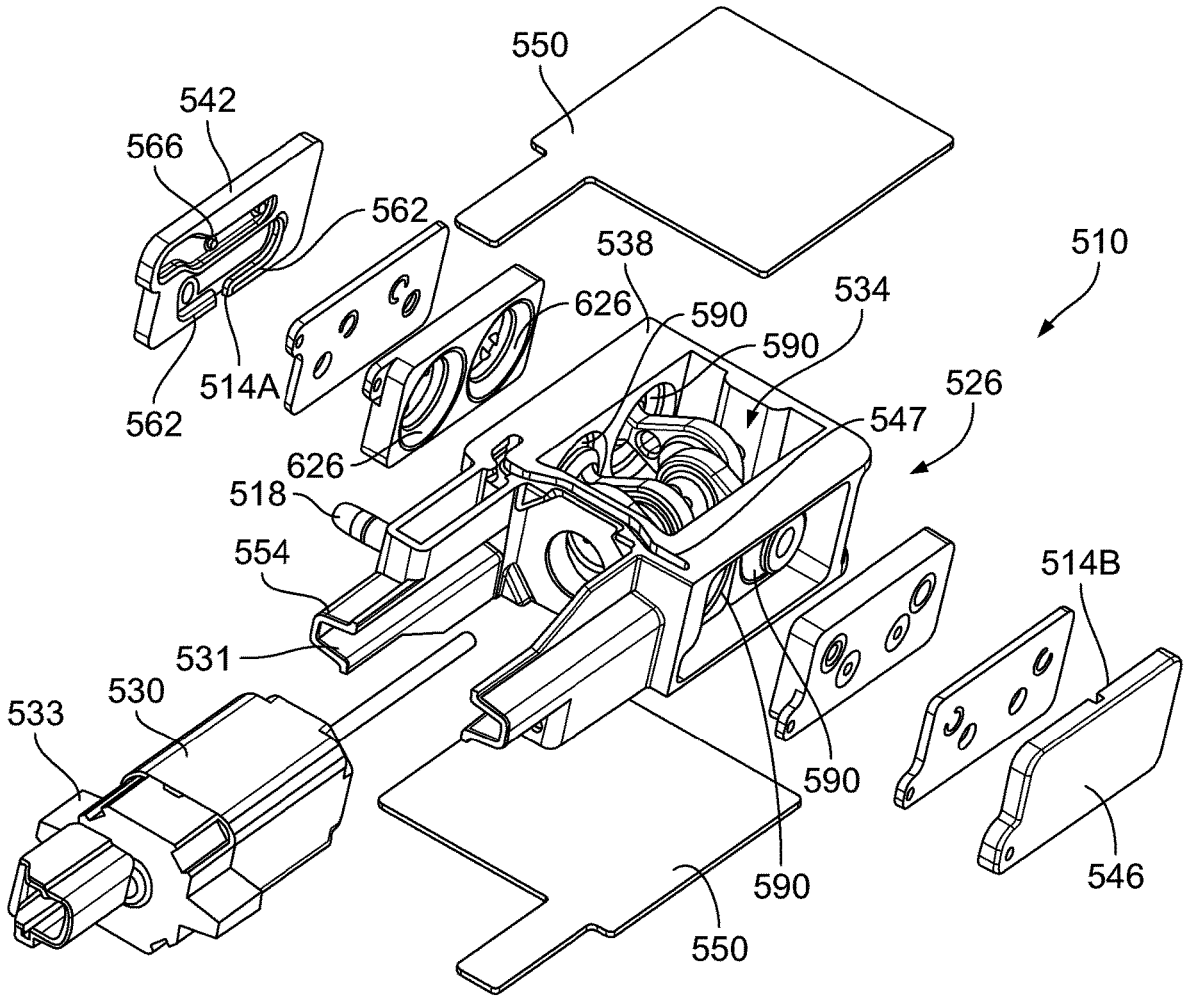
FIG. 7 is an exploded perspective view illustrating a pump assembly according to another embodiment of the present disclosure.
Figure 8:
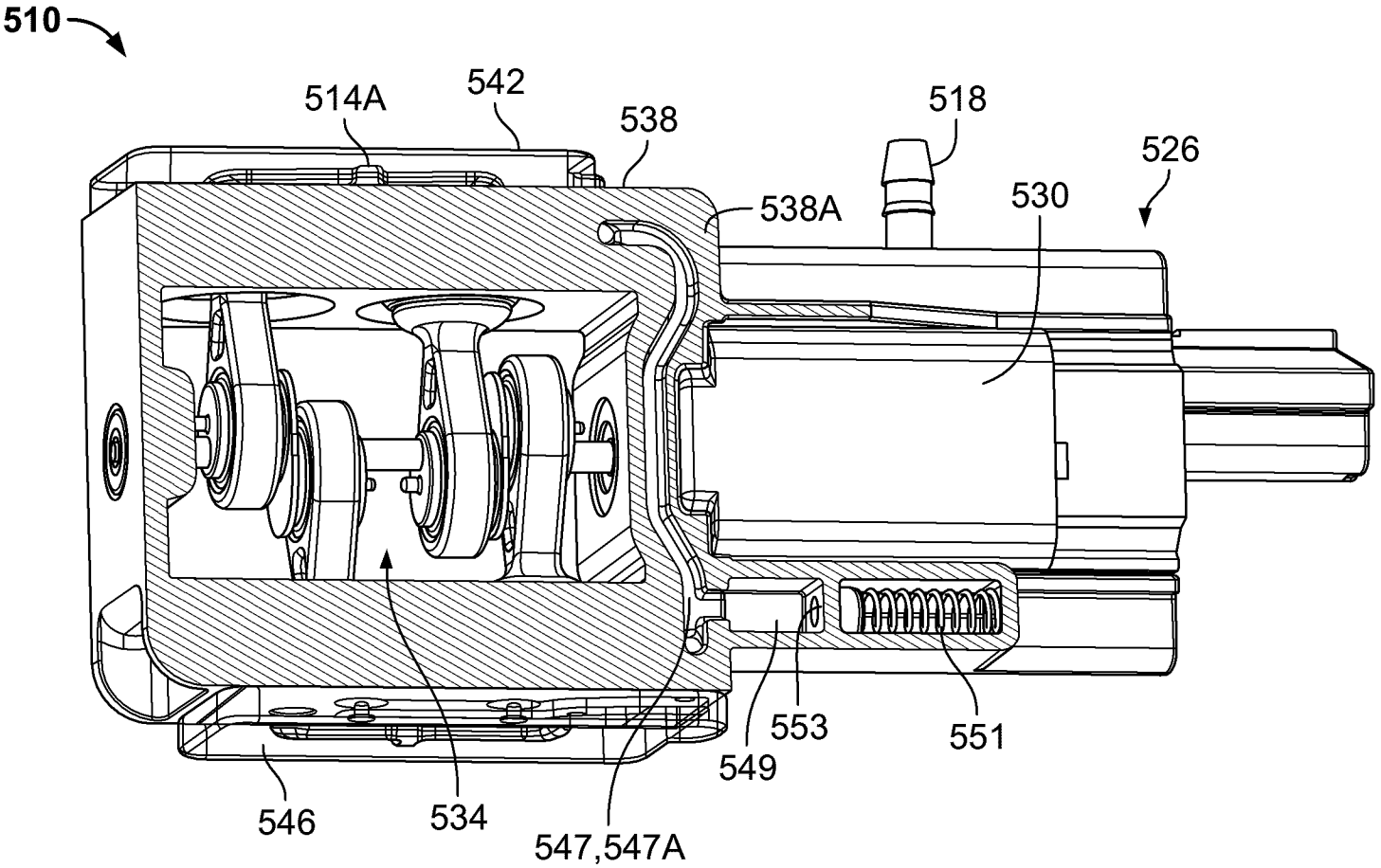
FIG. 8 is a perspective view of the pump assembly of FIG. 7, with a side cover removed.
Figure 9:
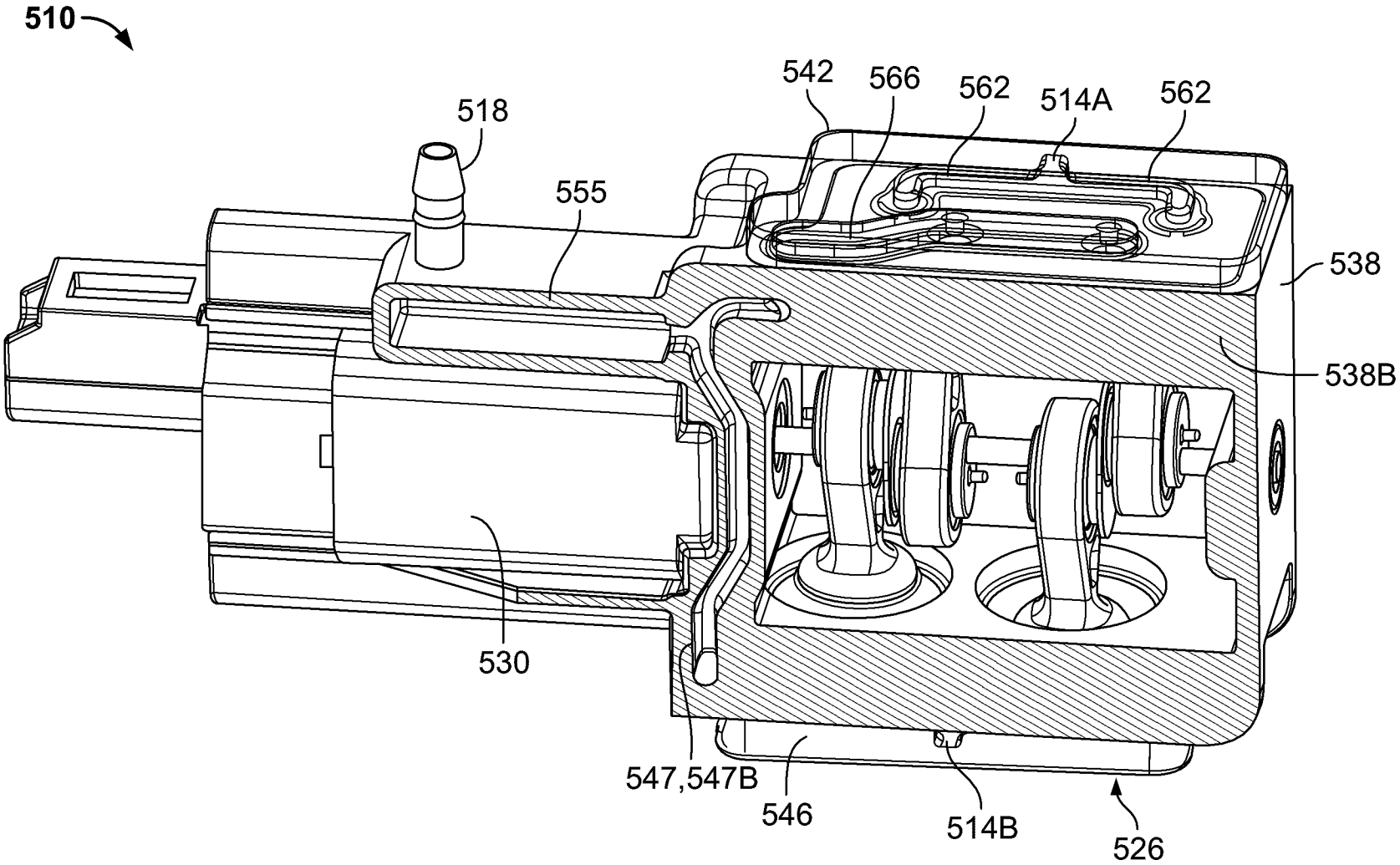
FIG. 9 is another perspective view of the pump assembly of FIG. 7, with an opposite side cover removed.

FIGS. 7-9 illustrate a pump assembly 510 according to another embodiment. The pump assembly 510 is similar in some aspects to the pump assembly 10 described above, and features and elements of the pump assembly 510 corresponding with features and elements of the pump assembly 10 are given corresponding reference numbers plus '500.' In addition, the following description focuses primarily on differences between the pump assembly 510 and the pump assembly 10. It should be understood that the pump assembly 510 may be incorporated into the pneumatic system 300, and features and elements of the pump assembly 510 may also be incorporated into the pump assembly 10 and vice versa.

With reference to FIG. 7, the pump assembly 510 includes a housing 526, a motor 530, and a pump drive mechanism 534, which, like the pump drive mechanism 34 described above, is configured to move a plurality of diaphragms 590 to draw air into associated air chambers 626 and then expel the air for use in a downstream application.

The housing 526 includes a main housing 538, an upper cover 542, a lower cover 546, a pair of side covers 550, and a motor bracket 554. The upper and lower covers 542, 546 and the side covers 550 are bonded to the main housing 538 in the illustrated embodiment via laser-welding, ultrasonic-welding, or any other suitable means. In addition, the motor bracket 554 is integrally formed as a single piece with the main housing 538 and includes a pair of slots 531 configured to receive corresponding projections 533 on the motor 530 to couple the motor 530 to the main housing 538. Thus, the pump assembly 510 may advantageously be assembled without mechanical fasteners, such as screws, bolts and the like. This may reduce the cost and/or weight of the pump assembly 510, and may also allow the size of the pump assembly 510 to be minimized, since mechanical fasteners may require a minimum material thickness to provide a secure hold. In alternate embodiments, however, the upper cover 542 and/or the lower cover 546 may be coupled to the main housing 538 by one or more fasteners. One or both side covers 550 may also be removably coupled to the main housing 538 with fasteners, a snap fit, or the like.

In the illustrated embodiment, the pump assembly 510 includes two air inlets 514A, 514B defined by openings in the upper and lower covers 542, 546, respectively. A single air outlet 518 is provided on the main housing 538. In other embodiments, the pump assembly 510 may include any other number of air inlets and/or air outlets positioned on the housing 526 in various ways.

The upper and lower covers 542, 546 may include air passageways. For example, the upper and lower covers 542, 546 each include air intake passageways 562 in fluid communication with the air inlets 514A, 514B, and an air outlet passageway 566 in fluid communication with the air outlet 518. The air intake passageways 562 route air from the air inlets 514A, 514B to the air chambers 626 during the intake stroke of the respective diaphragms 590. The air outlet passageways 566 route pressurized air from the air chambers 626 to the air outlet 518 during the pumping stroke of the respective diaphragms 590.

Referring to FIGS. 8-9, the outlet channel 547 includes a first portion 547A recessed into a first side 538A of the main housing 538 (FIG. 8) and a second portion 547B recessed into a second side 538B of the main housing 538 opposite the first side 538A (FIG. 9). The first portion 547A and the second portion 547B of the outlet channel 547 are in fluid communication via one or more connecting portions extending through the main housing 538.

Referring to FIG. 8, the first portion 547A of the outlet channel 547 fluidly communicates with a first chamber 549 integrally formed within the main housing 538. A relief valve 551 seals an opening 553 in the first chamber 549. The relief valve 551 may be any suitable type of relief valve, and in the illustrated embodiment is a spring-biased pressure relief valve. The relief valve 551 is configured to open at a predetermined pressure, allowing air to flow through the opening 553 and to the atmosphere or any other desired vent path. The relief valve 551 can thereby relieve excess pressure from the outlet channel 547. The relief valve 551 may advantageously protect the pump assembly 510 from overpressure (e.g., if the outlet 518 becomes blocked). In some embodiments, the relief valve 551 may be adjustable (e.g., via a set screw or the like) to vary the predetermined pressure to a desired setting. In other embodiments, the relief valve 551 may be pre-calibrated and may not be adjustable.

With reference to FIG. 9, the second portion 547B of the outlet channel 547 fluidly communicates with a second chamber 555 disposed fluidly between the outlet channel 547 and the outlet 518. The illustrated chamber 555 may act as a muffler to reduce noise produced during operation of the pump assembly 510. For example, in some embodiments, the chamber 555 may have a volume tuned to a particular resonant frequency or frequencies to attenuate noise produced by airflow exiting the pump assembly 510. In some embodiments, the chamber 555 may include one or more baffles, or other flow-affecting features.

In operation, air is drawn into the housing 526 of the pump assembly 510 through the air inlets 514A, 514B, and routed to the air chambers 626 of the respective diaphragms 590 via the air intake passageways 562 (FIG. 7). During each pumping stroke, air is discharged from the respective air chambers 626 and into the air outlet passageways 566, which lead to the outlet channel 547. The discharged air flows through the outlet channel 547 and into the second chamber 555 before exiting the pump assembly 510 through the outlet 518 (FIG. 9). If pressure in the outlet channel 547 increases above the predetermined cracking pressure of the relief valve 551, the relief valve 551 may open to vent air out of the outlet channel 547 (FIG. 8).

Because each of the air chambers 626 is in fluid communication with the single outlet 518, the pump assembly 510 in some embodiments may configured (e.g., by providing air outlet passageways 566 with different relative lengths and/or controlling the timing of the pump driving mechanism 534) to provide four pulses of air per revolution of the motor shaft. By providing a greater number of pulses, the relative magnitude of each particular pulse may be reduced compared to a pump that delivers one or two pulses per revolution, for example. This may further reduce the noise produced during operation of the pump assembly 510.

FIGS. 10-18 illustrate a pump assembly 710 according to another embodiment. The pump assembly 710 is similar in some aspects to the pump assembly 10 described above, and features and elements of the pump assembly 710 corresponding with features and elements of the pump assembly 10 are given corresponding reference numbers plus '700.' In addition, the following description focuses primarily on differences between the pump assembly 710 and the pump assembly 10. It should be understood that the pump assembly 710 may be incorporated into the pneumatic system 300, and features and elements of the pump assembly 710 may also be incorporated into the pump assembly 10 or the pump assembly 510 and vice versa.

Figure 10:
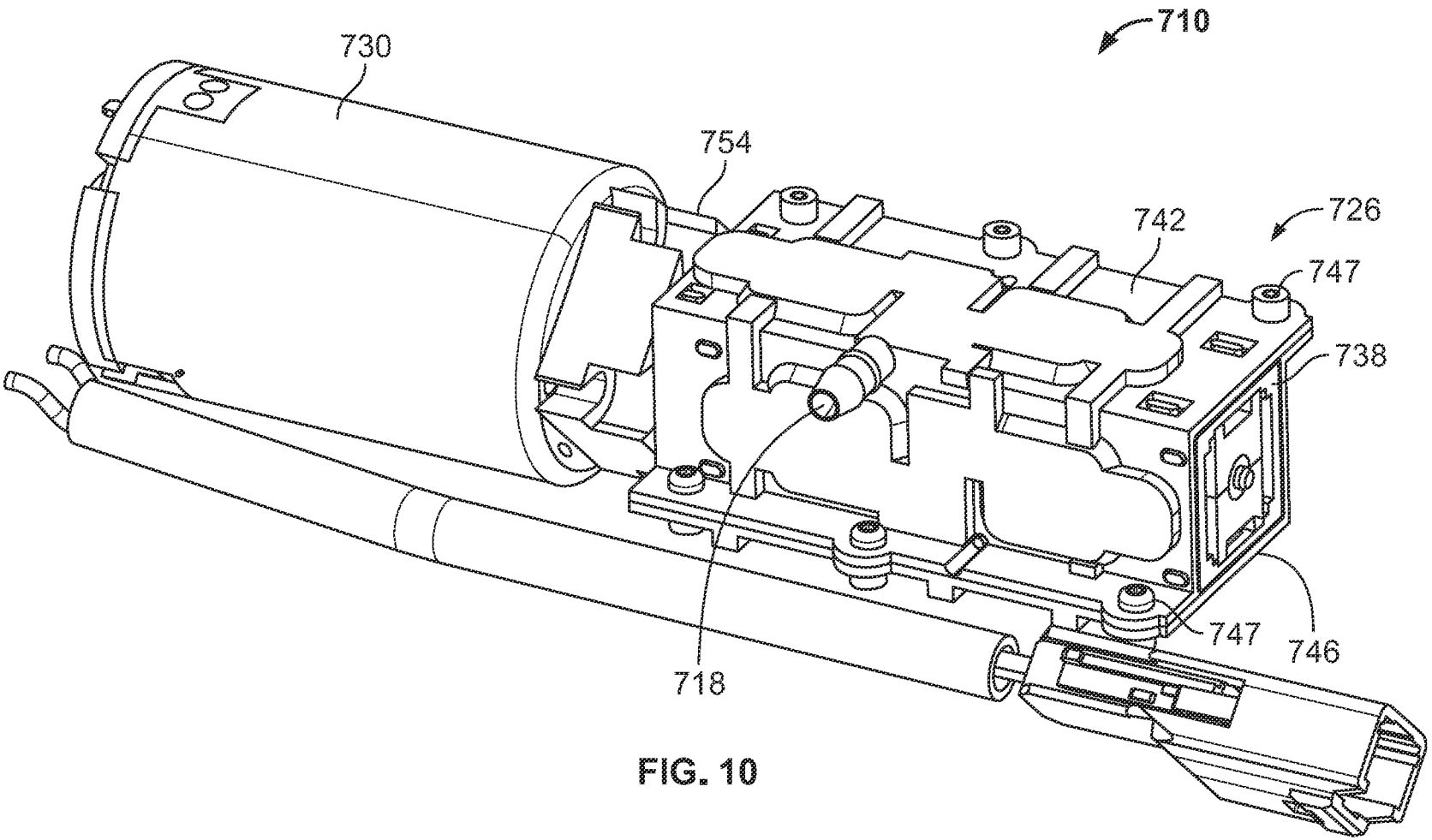
FIG. 10 is a perspective view of a pump assembly according to another embodiment of the present disclosure.
Figure 11:
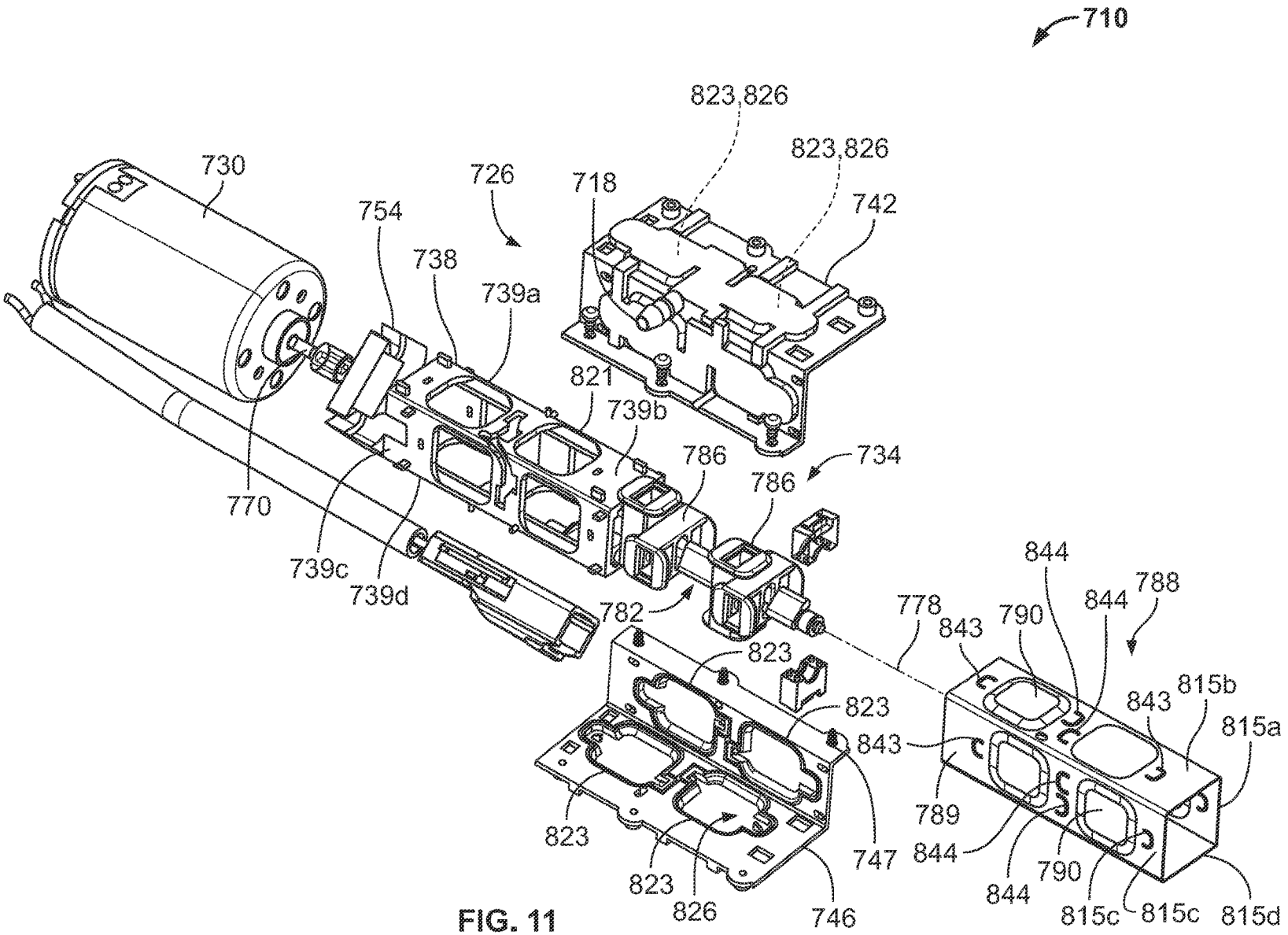
FIG. 11 is an exploded view of the pump assembly of FIG. 10.

With reference to FIGS. 10-11, the pump assembly 710 includes a housing 726, a motor 730, and a pump drive mechanism 734 (FIG. 11). The housing 726 includes a main housing 738, an upper cover 742, a lower cover 746, and a motor bracket 754. In the illustrated embodiment, the upper cover 742 and the lower cover 746 are each generally L-shaped, and the main housing 738 has a generally square cross-sectional shape with four sides 739*a-d*.

The upper and lower covers 742, 746 are coupled together by a plurality of fasteners 747, and the covers 742, 746 engage and surround an outer periphery of the main housing 738. In some embodiments, the main housing 738 may be clamped between the upper cover 742 and the lower cover 746 (e.g., by tightening the fasteners 747). In other embodiments, the components of the housing 726 may be coupled together in other ways. For example, the upper and lower covers 742, 746 may be laser-welded, ultrasonically-welded, or otherwise bonded to each other and/or the main housing 738.

The motor bracket 754 couples the motor 730 to the main housing 738 (e.g., via fasteners (not shown) extending through the motor bracket 754 and into the motor 730). The motor bracket 754 may be integrally formed with the main housing 738 or coupled to the main housing 738 via fasteners or in other ways.

Referring to FIG. 11, the motor 730 includes a drive shaft 770 that extends longitudinally through the motor bracket 754 and into the main housing 738. The motor 730 is configured to receive power (e.g., from the power source 301; FIG. 2) to rotate the drive shaft 770. The drive shaft 770 is rotatable about a first axis 778, which is a longitudinal center axis of the drive shaft 770 (FIG. 11).

With reference to FIGS. 11-16, the drive shaft 770 provides a rotational input to a pump drive mechanism 734. The illustrated pump drive mechanism 734 includes a crank shaft 782 and a plurality of connecting rods 786. The crank shaft 782 is coupled for co-rotation with the drive shaft 770 of the motor 730 via a flat 783 formed at an end of the crank shaft 782. As such, the motor 730 is operable to rotate the crank shaft 782 about the first axis 778. In other embodiments, the crank shaft 782 may be coupled to the drive shaft 770 in other ways (e.g., via a key and keyway arrangement, a spline pattern, or the like). In some embodiments, a transmission, one or more intermediate shafts, and/or one or more gear stages may be provided between the drive shaft 770 and the crank shaft 782. In yet other embodiments, the drive shaft 770 and the crank shaft 782 may be integrally formed together as a single piece.

Figure 12:
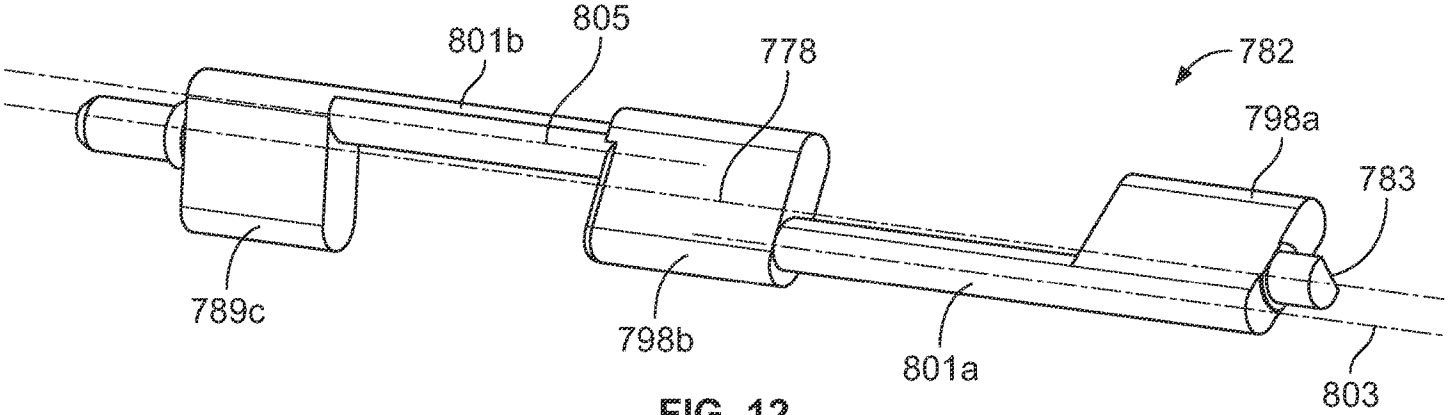
FIG. 12 is a perspective view of a crank shaft of the pump assembly of FIG. 10.

Referring to FIG. 12, the crank shaft 782 includes three counterweight portions 798*a*, 798*b*, 798*c* and two offset rod segments 801*a*, 801*b*. The first offset rod segment 801*a* defines a second axis 803 parallel to the first axis 778 and offset in a first direction from the first axis 778. The second offset rod segment 801*b* defines a third axis 805 parallel to the first axis 778 and offset in a second direction from the first axis 778 that is opposite the first direction. As such, the offset rod segments 801*a*, 801*b* are positioned eccentrically on opposite sides of the first axis 778.

With continued reference to FIG. 12, the first offset rod segment 801*a* extends between the first and second counterweight portions 798*a*, 798*b*, and the second offset rod segment 801*b* extends between the second and third counterweight portions 798*b*, 798*c*. As such, the second counterweight portion 798*b* is positioned between the two offset rod segments 801*a*, 801*b*. The counterweight portions 798*a*, 798*b* and offset rod segments 801*a*, 801*b* are all integrally formed together as a single piece of material in the illustrated embodiment; however, the crank shaft 782 may include multiple components coupled together in any suitable manner in other embodiments. For example, one or more of the counterweight portions 798*a-c* may be formed separately and coupled to the crank shaft 782 in an adjustable manner to permit the balance of the crank shaft 782 to be adjusted.

Figure 13:
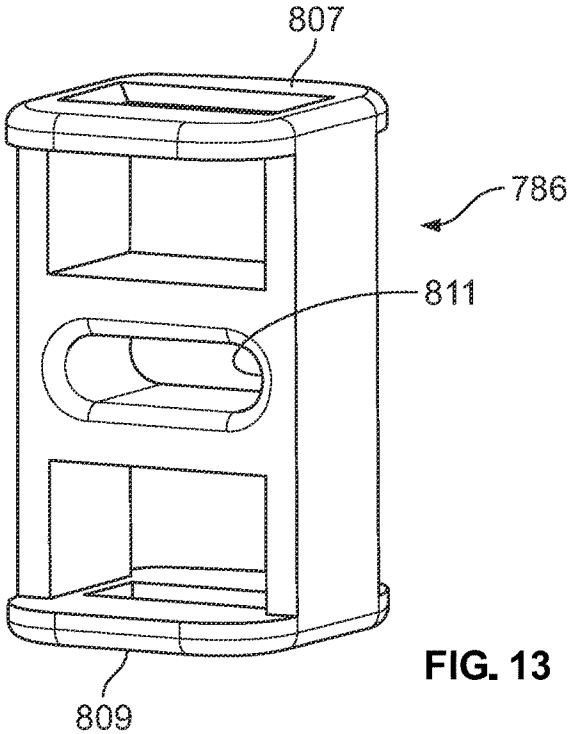
FIG. 13 is a perspective view of a connecting rod of the pump assembly of FIG. 10.

With reference to FIG. 13, each connecting rod 786 includes a first end 807 and a second end 809 opposite the first end 807. A distance between the first end 807 and the second end 809 defines a length of the connecting rod 786. A slot 811 is formed in a center portion of the connecting rod 786, midway between the ends 807, 809. The slot 811 is elongated in a width direction of the connecting rod 786 and is sized to receive one of the offset rod segments 801*a*, 801*b* thereinto couple the connecting rod 786 to the crank shaft 782.

Figure 15:
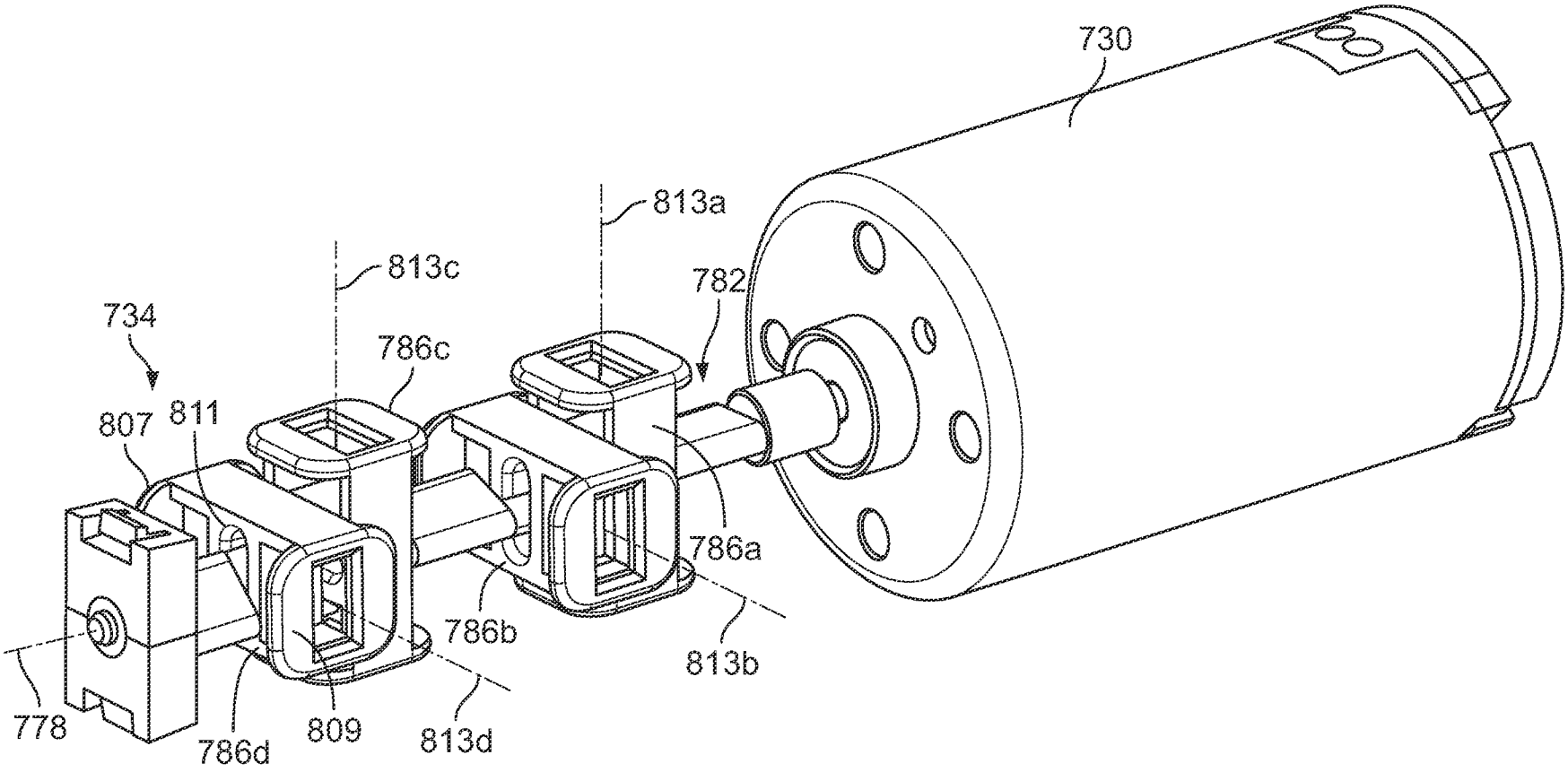
FIG. 15 is a perspective view of the drive mechanism of FIG. 14 with the diaphragm assembly hidden.
Figure 16:
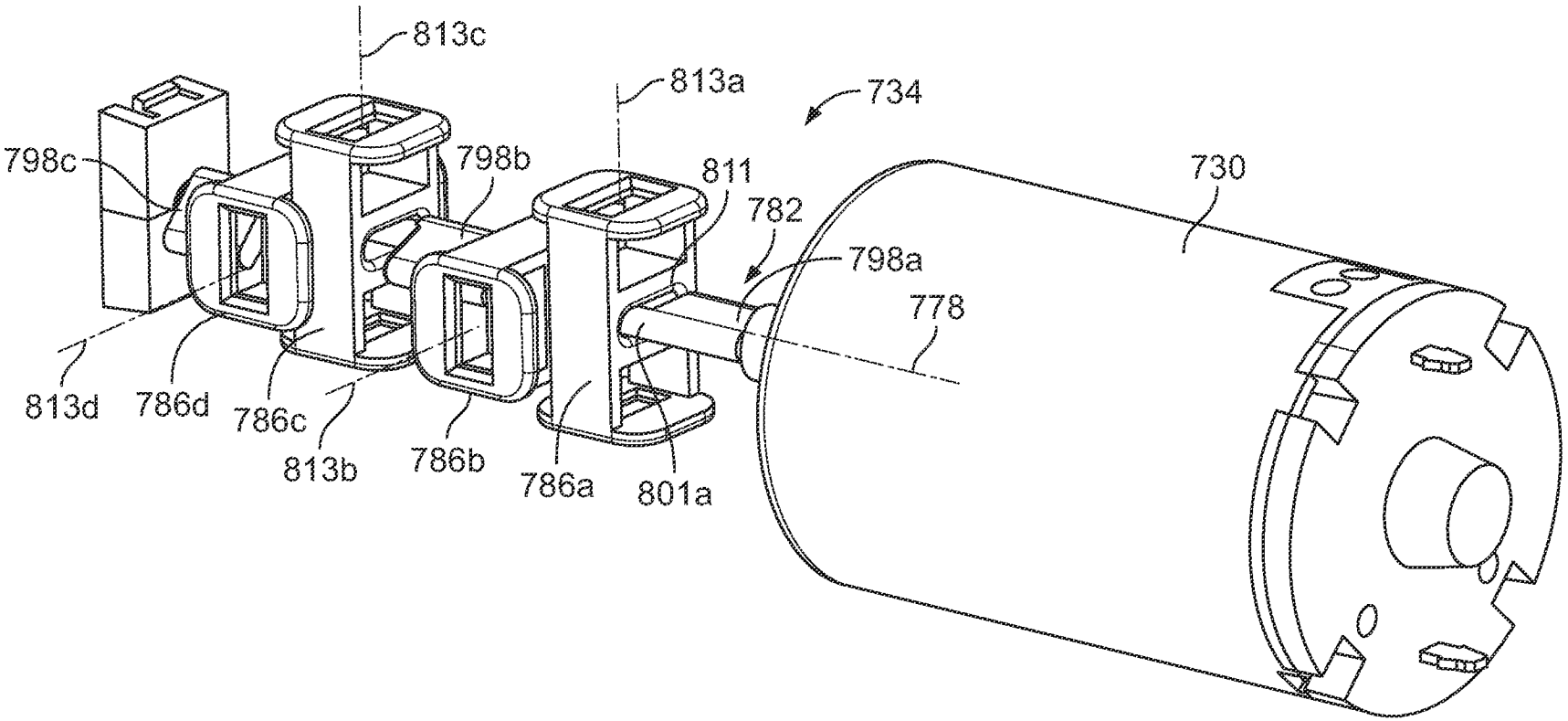
FIG. 16 is another perspective view of the drive mechanism of FIG. 14 with the diaphragm assembly hidden.

Referring to FIGS. 15-16, in the illustrated embodiment, the pump drive mechanism 734 includes four connecting rods 786*a-d*. The connecting rods 786*a-d* are spaced along the length of the crank shaft 782 (i.e. along the first axis 778). The first connecting rod 786*a*, which is nearest the motor 730 in the illustrated embodiment, is oriented with its length extending along a first connecting rod axis 813*a*. The second connecting rod 786*b*, which is positioned adjacent the first connecting rod 786*a*, is rotated 90-degrees about the first axis 778 relative to the first connecting rod 786*a*. As such, the second connecting rod 786*b* is oriented with its length extending along a second connecting rod axis 813*b* transverse to the first connecting rod axis 813*a*. The third connecting rod 786*c* is rotated 90-degrees about the first axis 778 relative to the second connecting rod 786*b*. As such, the third connecting rod 786*b* is oriented with its length extending along a third connecting rod axis 813*c* transverse to the second connecting rod axis 813*b* and parallel to the first connecting rod axis 813*a*. Finally, the fourth connecting rod 786*d*, which is positioned adjacent the third connecting rod 786*c*, is rotated 90 degrees about the first axis 778 relative to the third connecting rod 786*c*. As such, the fourth connecting rod 786*d* is oriented with its length extending along a fourth connecting rod axis 813*d* transverse to the third connecting rod axis 813*c* and parallel to the second connecting rod axis 813*b*. Thus, the connecting rods 786*a-d* are oriented relative to one another with alternating 90-degree offsets.

With continued reference to FIGS. 15-16, the first offset rod segment 801*a* extends through the slots 811 of the first and second connecting rods 786*a*, 786*b*, and the second offset rod segment 801*b* extends through the slots 811 of the third and fourth connecting rods 786*c*, 786*d*. In some embodiments, the counterweight portions 798*a-c* (FIG. 12) are sized to be able to pass through the slots 811 of the connecting rods 786*a-d*, thereby facilitating assembly of the connecting rods 786*a-d* on to the crank shaft 782. Because the rod segments 801*a*, 801*b* are offset from the first axis 778, the rod segments 801*a*, 801*b* bear against the sides of the slots 811, causing the connecting rods 786*a-d* to reciprocate along their respective connecting rod axes 813*a-d* when the motor 730 rotates the crank shaft 782 about the first axis 778. Thus, the pump drive mechanism 734 converts a rotational input from the motor 730 into reciprocating movement of the connecting rods 786*a-d*.

Figure 14:
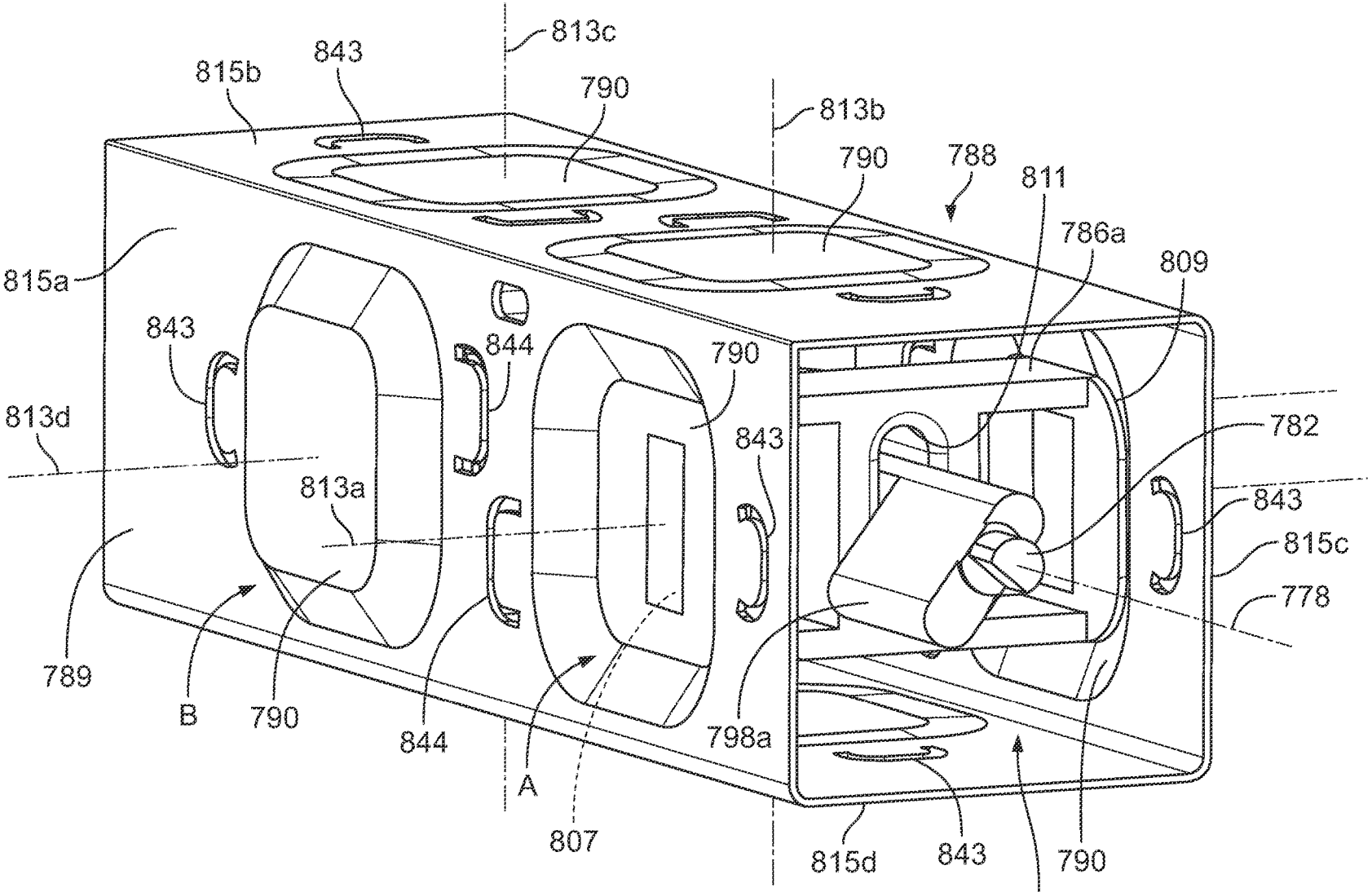
FIG. 14 is a perspective view of a pump drive mechanism of the pump assembly of FIG. 10, including the crank shaft of FIG. 12 and the connecting rod of FIG. 13 coupled to a diaphragm assembly.

With reference to FIG. 14, the pump assembly 710 further includes a diaphragm assembly 788 having a main body 789 interconnecting a plurality of flexible diaphragms 790. In the illustrated embodiment, the main body 789 and the diaphragms 790 are integrally formed together as a single piece from a suitably flexible material, such as silicone, rubber, or the like. The unitary construction of the diaphragm assembly 788 may advantageously facilitate assembly of the pump assembly 710 and reduce costs. In some embodiments, the diaphragms 790 may be thinner than the main body 789 to provide the diaphragms 790 with greater flexibility. In some embodiments, the diaphragms 790 may be formed separately from the main body 789 and coupled to the main body 789 in any suitable manner.

The main body 789 includes four sides 815*a-d*. In the illustrated embodiment, the main body 789 has a generally square cross-sectional shape. The first and third sides 815*a*, 815*c* are parallel to each other, and the second and fourth sides 815*b*, 815*d* are parallel to each other and also orthogonal to the first and third sides 815*a*, 815*c*. The diaphragm assembly 788 is assembled on to the main housing 838 such that the main body 789 of the diaphragm assembly 788 surrounds the periphery of the main housing 838 (FIG. 11). More specifically, the first side 815*a* of the main body 789 overlies the first side 739*a* of the main housing 838, the second side 815*b* of the main body 789 overlies the second side 739*b* of the main housing 838, the third side 815*c* of the main body 789 overlies the third side 739*c* of the main housing 838, and the fourth side 815*d* of the main body 789 overlies the fourth side 739*d* of the main housing 838. Thus, when the upper and lover covers 742, 746 are assembled around the main housing 838, the diaphragm assembly 788 is positioned between the outer periphery of the main housing 838 and the interior sides of the covers 742, 746.

Each of the four sides 815*a-d* includes two diaphragms 790, such that the illustrated diaphragm assembly 788 includes eight diaphragms 790 in total. Thus, the illustrated diaphragm assembly 788 includes pairs of diaphragms 790 provided in four separate planes, each containing a respective one of the four sides 815*a-d* of the main body 789.

Each of the connecting rods 786*a-d* is coupled to two diaphragms 790 located on opposite sides of the main body 789. For example, as shown in FIG. 14, the first end 807 of the first connecting rod 786*a* is coupled to a diaphragm 790 on the first side 815*a* of the main body 789, and the second end 809 of the first connecting rod 786*a* is coupled to a diaphragm 790 on the third side 815*c* of the main body 789. The remaining connecting rods 786*a-c* are coupled to opposite diaphragms 790 in a similar manner. In other embodiments, the pump assembly 410 may include other arrangements of diaphragms 790 and connecting rods 786. For example, the pump assembly 410 in some embodiments may include three connecting rods 786 and six diaphragms 790, five connecting rods 786 and ten diaphragms 790, etc.

With continued reference to FIG. 14, the ends 807, 809 of the connecting rods 786*a-d* are coupled to the diaphragms 790 by welding (e.g., laser welding, hot plate welding, ultrasonic welding, etc.), one or more fasteners, a clamping structure, or the like. As such, reciprocation of the connecting rods 786*a-d* causes the center of each diaphragm 790 to flex relative to the main body 789 along the respective axes 813*a-d*. Each diaphragm 790 is movable between an intake position A, in which the diaphragm 790 is drawn inwardly toward a center of the main body 789, and a compression position B, in which the diaphragm 790 is pushed outwardly away from the center of the main body 789. The main housing 738 includes apertures 821 aligned with the diaphragms 790 to permit the diaphragms 90 to move into main housing 738 to the intake position A (FIG. 11).

Referring to FIG. 11, the inner sides of the upper and lower covers 742, 746 each include a plurality of recesses 823. The recesses 823 are aligned with the respective apertures 821 in the main housing 738 and the associated diaphragms 790. The diaphragms 790 and the recesses 823 define air chambers 826 therebetween. Thus, in the illustrated embodiment, the pump assembly 710 includes eight recesses 823 and eight air chambers 826. In other embodiments, the number of recesses 823 and air chambers 826 may vary with the number of diaphragms 790.

Figure 17:
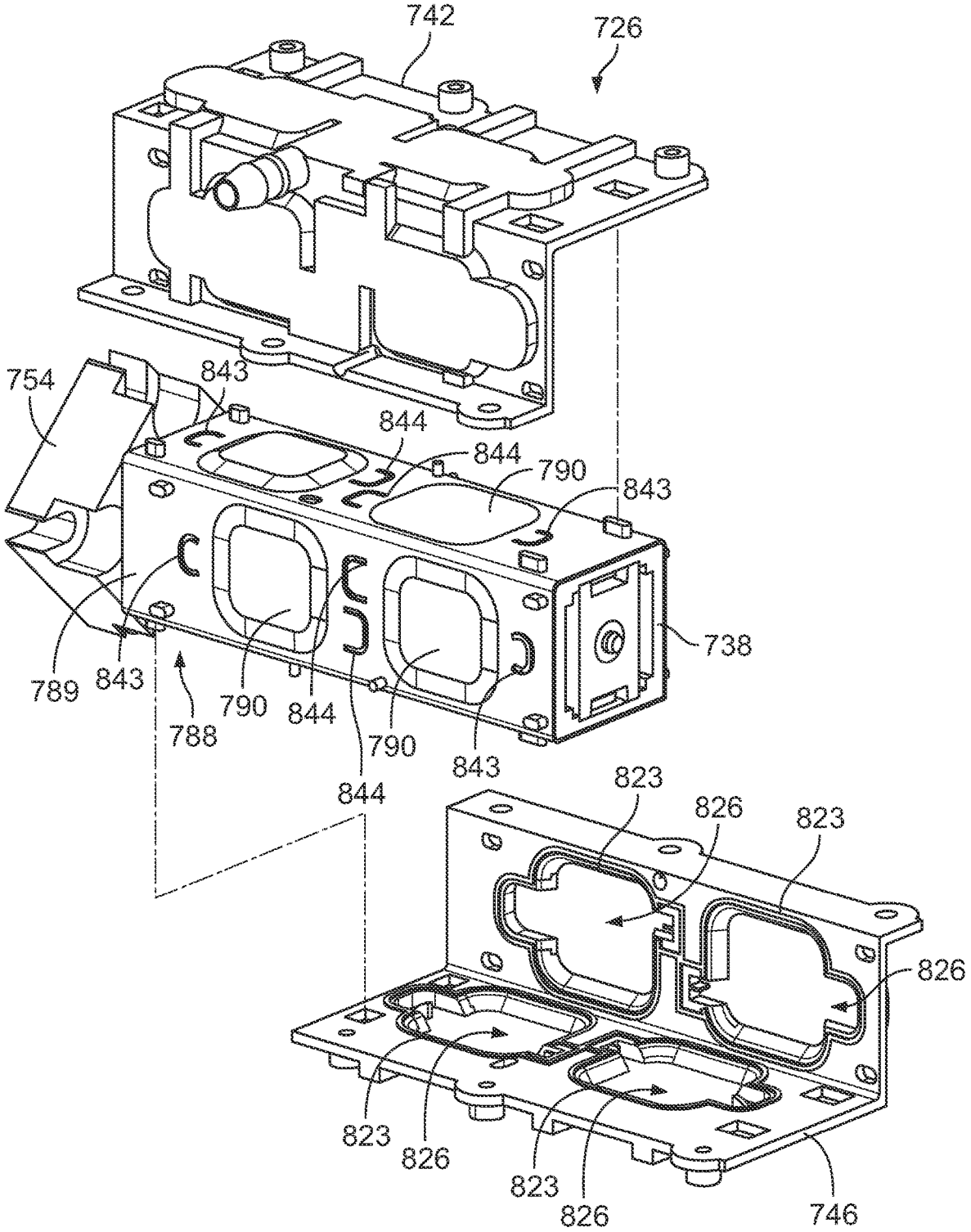
FIG. 17 is an exploded view of a portion of the pump assembly of FIG. 10, illustrating the diaphragm assembly.

With reference to FIGS. 14 and 17, the illustrated diaphragm assembly 788 includes a plurality of air intake valves 843 and a plurality of air outlet valves 844 that regulate air entering and exiting the air chambers 826. In some embodiments, the valves 843, 844 may be one-way valves, such as reed valves, that allow air to only transfer in only one direction. That is, the air intake valves 843 may be configured to allow air to flow into the air chambers 826 in response to negative pressure within the chambers 826, and the air outlet valves 844 may be configured to allow air to flow out of the chambers 826 in response to positive pressure within the chambers 826. In other embodiments, the valves may be any other suitable valve to regulate air exiting and entering the air chambers 826.

Figure 18:
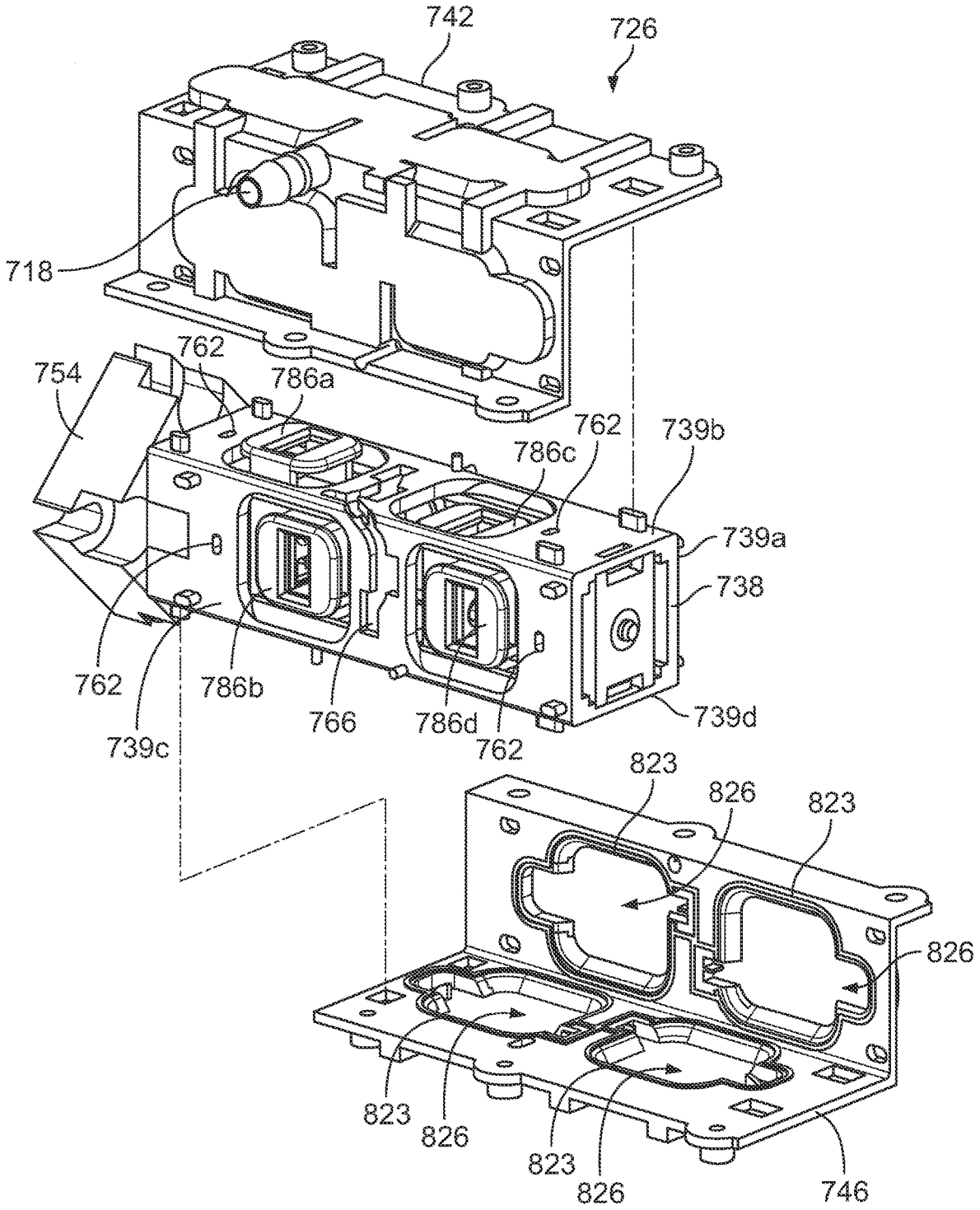
FIG. 18 is an exploded view of the portion of the pump assembly of FIG. 17 with the diaphragm assembly hidden.

With reference to FIGS. 17-18, each of the air intake valves 843 (FIG. 17) is positioned over a respective air intake passageway 762 extending through the main housing 738 (FIG. 18). The air intake passageways 762 fluidly connect the air intake valves 843 with the interior of the main housing 738, which, in the illustrated embodiment, is open to the surrounding environment (e.g., through the ends of the main housing 738). Each of the air outlet valves 844 (FIG. 17) is positioned over an air outlet passageway 766 (FIG. 18). The air outlet passageway 766 is recessed into the main housing 738 such that the diaphragm assembly 788 forms a portion of an outer lateral wall of the air outlet passageway 766 apart from each air outlet valve 844 in fluid communication with the air outlet passageway 766, which air outlet passageway 766 is in fluid communication with an outlet 718 of the pump assembly 710. In the illustrated embodiment, the pump assembly 710 includes a single outlet 718 located on the upper cover 742. The air outlet passageway 766 thus routes air from all of the air outlet valves 844 to the outlet 718. In other embodiments, the pump assembly 710 may include two outlets 718 (e.g., one on each of the covers 742, 746) or any other number of outlets 718 as may be desired to suit a particular application of the pump assembly 710.

During operation of the pump assembly 710, the motor 730 rotates the drive shaft 770. The drive shaft 770 rotates the crank shaft 782 about the first axis 778, and thus the connecting rods 786*a-d* reciprocate along their respective connecting rod axes 813*a-d*. As the connecting rods 786*a-d* reciprocate, the diaphragms 790 flex from the intake position A to the compression position B (FIG. 14). Movement of the diaphragms 90 from the intake position A to the compression position B draws air into the pump assembly 710 and discharges air through the outlet 718.

In some embodiments, the crank shaft 782 is configured such that each of the connecting rods 786*a-d* is offset 90 degrees from its adjacent connecting rod(s) 786*a-d*. This arrangement, together with an appropriate phase overlap and the two-sided construction of the connecting rods 786*a-d* (and corresponding positioning of diaphragms 790 on opposite sides of the axis 778) and the counterweights 798*a-c*, advantageously reduces vibration and noise by effectively cancelling out first and second order forces and moments exerted by the moving the connecting rods 786*a-d* on the crank shaft 782. In other embodiments, the crank shaft 782 may be configured to provide different phase differences between the connecting rods 786*a-d*. For example, in some embodiments, movement of the first and third connecting rods 786*a*, 786*c* may be in the same phase or 180 degrees out of phase, and movement of the second and fourth connecting rods 786*b*, 786*d* may be in the same phase or 180 degrees out of phase.

Movement of each of the diaphragms 790 from the compression position B to the intake position A (i.e. the intake stroke) creates negative pressure within the respective air chambers 826, which draws air into the housing 726. The airflow is then drawn from the interior of the main housing 738, through the air inlet passageways 762, through the air intake valves 843, and into the air chambers 826.

As the diaphragms 790 are moved from the intake position A to the compression position B, the air is forced out of the air chambers 826 and through the air outlet valves 844. The expelled air then flows into the air outlet passageway 766. From the air outlet passageway 766, the air is directed through the air outlet 718 (e.g., and into the pneumatic line 300 where it may be used as described above in reference to the pneumatic system 300 (FIG. 2).

In the illustrated embodiment, the pump assembly 710 may be operable to pump at least 6 liters of fluid (e.g., air, or other pumpable fluids) per minute. Additionally, the pump assembly 710 may be operable to produce a pump outlet pressure of at least 70 kPa.

The pump assembly 10 described and illustrated herein thus includes multiple diaphragms 790, arranged in four planes that are not co-planar. In the illustrated embodiment, the pump assembly 10 includes multiple diaphragms in each of the four planes. The diaphragms 790 are actuated by a central crank shaft 782, which allows the phase of each diaphragm 790 to be independently set to minimize noise and vibration. This arrangement may also provide a relatively high pumping capacity or maximum flow rate, while minimizing the overall size of the pump assembly 710. As such, the pump assembly 710 and variations thereof described and/or illustrated herein may be particularly advantageous for use in applications, (such as automotive, furniture, and aviation applications), in which operating noise, vibration, and package size are of high importance. Finally, because each of the air chambers 826 is in fluid communication with the single outlet 718, the pump assembly 710 in some embodiments may configured to provide four or more pulses of air per revolution of the drive shaft 770. By providing a greater number of pulses, the relative magnitude of each particular pulse may be reduced compared to a pump that delivers one or two pulses per revolution, for example. This may further reduce the noise produced during operation of the pump assembly 710.

Various features and advantages of the disclosure are set forth in the following claims.

What is claimed is:

1. A pump assembly comprising:

a housing including a main housing, an upper cover, a lower cover, a fluid outlet and an interior volume open to the surrounding environment through open ends of the main housing, wherein a fluid flow is drawn into the interior volume of the main housing through the open ends of the main housing;

a motor supported by the interior volume of the main housing, the motor including a drive shaft rotatable about a drive shaft axis;

a crankshaft coupled to the drive shaft for rotation by the drive shaft;

a diaphragm assembly supported by the main housing and including a first, second, third, and fourth diaphragm, wherein the main housing and diaphragm assembly are configured such that each of the first, second, third, and fourth diaphragms is fluidly connected with the interior volume of the main housing to receive the fluid flow drawn into the interior volume of the main housing;

a first connecting rod coupled to the crankshaft and to the first diaphragm and the second diaphragm, the first connecting rod configured to reciprocate along a first connecting rod axis in response to rotation of the crankshaft to move the first diaphragm between an intake position and a compression position to pump the fluid flow drawn into the interior volume of the main housing through the fluid outlet and to move the second diaphragm between an intake position and a compression position to pump the fluid flow drawn into the interior volume of the main housing through the fluid outlet out of phase with the first diaphragm; and a second connecting rod coupled to the crankshaft and to the third diaphragm and the fourth diaphragm, the second connecting rod configured to reciprocate along a second connecting rod axis that is not parallel to the first connecting rod axis in response to rotation of the crankshaft to move the third diaphragm between an intake position and a compression position to pump the fluid flow drawn into the interior volume of the main housing through the fluid outlet and to move the fourth diaphragm between an intake position and a compression position to pump the fluid flow drawn into the interior volume of the main housing through the fluid outlet out of phase with the third diaphragm, wherein the second connecting rod axis is offset from the first connecting rod axis in a direction along the drive shaft axis, wherein the first diaphragm is positioned along a first plane of the main housing, the second diaphragm is positioned along a second plane of the main housing spaced apart from and parallel to the first plane, the third diaphragm is positioned along a third plane of the main housing orthogonal to the first and second planes, and the fourth diaphragm is positioned along a fourth plane of the main housing spaced apart from and parallel to the third plane, wherein the first, second, third, and fourth diaphragms define a diaphragm assembly positioned between an exterior surface of the main housing and an interior surface of each he upper and lower covers, the diaphragm assembly further including a plurality of air intake valves and a plurality of air outlet valves, wherein each diaphragm of the diaphragm assembly is associated with an aperture provided in the main housing, wherein each of the upper and lower covers includes a plurality of recesses each aligned with a respective aperture in the main housing and an associated diaphragm, wherein each pair of aligned recesses and diaphragms defines an air chamber therebetween, wherein each air chamber is in fluid communication with a respective air intake valve of the plurality of air intake valves and a respective air outlet valve of the plurality of air outlet valves, wherein the air outlet valve for the air chamber of the first diaphragm and the air outlet valve for the air chamber of the third diaphragm are each in fluid communication with a first air outlet passageway recessed into the first and third planes of the exterior surface of the main housing between the diaphragm assembly and the exterior surface of the main housing such that the diaphragm assembly forms a portion of an outer lateral wall of the first air outlet passageway apart from each air outlet valve in fluid communication with the first air outlet passageway, wherein the air outlet valve for the air chamber for the second diaphragm and the air outlet valve for the air chamber for the fourth diaphragm are each in fluid communication with a second air outlet passageway recessed into the second and fourth planes of the exterior surface of the main housing between the diaphragm assembly and the exterior surface of the main housing such that the diaphragm assembly forms a portion of an outer lateral wall of the second air outlet passageway apart from each air outlet valve in fluid communication with the second air outlet passageway, wherein each of the first and second air outlet passageways is configured to provide fluid communication to the fluid outlet from two air chambers orthogonally positioned relative to each other.

2. The pump assembly of claim 1, wherein the first diaphragm is positioned on a first end of the first connecting rod and the second diaphragm is positioned on a second end of the first connecting rod opposite the first end of the first connecting rod such that the first diaphragm and the second diaphragm move together in the same direction with the reciprocating first connecting rod, and the third diaphragm is positioned on a first end of the second connecting rod and the fourth diaphragm is positioned on a second end of the second connecting rod opposite the first end of the second connecting rod such that the third diaphragm and the fourth diaphragm move together in the same direction with the reciprocating second connecting rod.

3. The pump assembly of claim 1, further comprising a third connecting rod coupled to the crankshaft and to a fifth diaphragm and a sixth diaphragm, the third connecting rod configured to reciprocate along a third connecting rod axis that is parallel to the first connecting rod axis in response to rotation of the crankshaft to move the fifth diaphragm between an intake position and a compression position to pump the fluid flow drawn into the interior volume of the main housing through the fluid outlet and to move the sixth diaphragm between an intake position and a compression position to pump the fluid flow drawn into the interior volume of the main housing through the fluid outlet out of phase with the fifth diaphragm, wherein the third connecting rod axis is offset from the second connecting rod axis in a direction along the drive shaft axis; and a fourth connecting rod coupled to the crankshaft and to a seventh diaphragm and an eighth diaphragm, the fourth connecting rod configured to reciprocate along a fourth connecting rod axis that is parallel to the second connecting rod axis in response to rotation of the crankshaft to move the seventh diaphragm between an intake position and a compression position to pump the fluid flow drawn into the interior volume of the main housing through the fluid outlet and to move the eighth diaphragm between an intake position and a compression position to pump the fluid flow drawn into the interior volume of the main housing through the fluid outlet out of phase with the seventh diaphragm, wherein the fourth connecting rod axis is offset from the third connecting rod axis in a direction along the drive shaft axis.

4. The pump assembly of claim 3, wherein the third connecting rod reciprocates out of phase with the first connecting rod and the fourth connecting rod reciprocates out of phase with the second connecting rod.

5. The pump assembly of claim 1, wherein the drive shaft axis is a first axis and the crankshaft includes a first offset rod segment having a second axis parallel to and offset from the first axis in a first direction from the first axis and a second offset rod segment offset from the first offset rod segment in a direction along the first axis and having a third axis parallel to and offset from the first axis in a second direction opposite from the first direction, and wherein the first connecting rod is coupled to the first offset rod segment and the second connecting rod is coupled to the first offset rod segment.

6. The pump assembly of claim 5, wherein the first connecting rod axis is orthogonal to the second connecting rod axis.

7. The pump assembly of claim 5, further comprising a third connecting rod coupled to the second offset rod segment and to a fifth diaphragm and a sixth diaphragm, the third connecting rod configured to reciprocate along a third connecting rod axis that is parallel to the first connecting rod axis in response to rotation of the crankshaft to move the fifth diaphragm between an intake position and a compression position to pump the fluid flow drawn into the interior volume of the main housing through the fluid outlet and to move the sixth diaphragm between an intake position and a compression position to pump the fluid flow drawn into the interior volume of the main housing through the fluid outlet out of phase with the fifth diaphragm, wherein the third connecting rod axis is offset from the second connecting rod axis in a direction along the drive shaft axis; and a fourth connecting rod coupled to the second offset rod segment and to a seventh diaphragm and an eighth diaphragm, the fourth connecting rod configured to reciprocate along a fourth connecting rod axis that is parallel to the second connecting rod axis in response to rotation of the crankshaft to move the seventh diaphragm between an intake position and a compression position to pump the fluid flow drawn into the interior volume of the main housing through the fluid outlet and to move the eighth diaphragm between an intake position and a compression position to pump the fluid flow drawn into the interior volume of the main housing through the fluid outlet out of phase with the seventh diaphragm, wherein the fourth connecting rod axis is offset from the third connecting rod axis in a direction along the drive shaft axis.

8. The pump assembly of claim 7, wherein the third connecting rod reciprocates out of phase with the first connecting rod and the fourth connecting rod reciprocates out of phase with the second connecting rod.

9. The pump assembly of claim 7, wherein the fifth diaphragm is configured to move between the intake position and the compression position out of phase with the sixth diaphragm and the seventh diaphragm is configured to move between the intake position and the compression position out of phase with the eighth diaphragm.

10. The pump assembly of claim 7, wherein the third connecting rod axis is orthogonal to the fourth connecting rod axis.

11. The pump assembly of claim 7, wherein the fifth diaphragm is configured to move between the intake position and the compression position out of phase with the first diaphragm and the eighth diaphragm is configured to move between the intake position and the compression position out of phase with the third diaphragm.

12. The pump assembly of claim 7, wherein the fifth diaphragm is positioned on a first end of the third connecting rod and the sixth diaphragm is positioned on a second end of the third connecting rod opposite the first end of the third connecting rod such that the fifth diaphragm and the sixth diaphragm move together in the same direction with the reciprocating third connecting rod, and the seventh diaphragm is positioned on a first end of the fourth connecting rod and the eighth diaphragm is positioned on a second end of the fourth connecting rod opposite the first end of the fourth connecting rod such that the seventh diaphragm and the eighth diaphragm move together in the same direction with the reciprocating fourth connecting rod.

13. The pump assembly of claim 5, wherein the first offset rod segment extends between first and second counterweight portions of the crankshaft and the second offset rod segment extends between the second counterweight portion and a third counterweight portion of the crankshaft.

14. The pump assembly of claim 5, wherein the first diaphragm is positioned on a first end of the first connecting rod and the second diaphragm is positioned on a second end of the first connecting rod opposite the first end of the first connecting rod such that the first diaphragm and the second diaphragm move together in the same direction with the reciprocating first connecting rod, and the third diaphragm is positioned on a first end of the second connecting rod and the fourth diaphragm is positioned on a second end of the second connecting rod opposite the first end of the second connecting rod such that the third diaphragm and the fourth diaphragm move together in the same direction with the reciprocating second connecting rod.

15. The pump assembly of claim 1, wherein the housing includes an upper cover and a lower cover, wherein the diaphragm assembly has a main body formed as a single piece of material, wherein the first, second, third, and fourth diaphragms the plurality of air intake valves, and the plurality of air outlet valves are integrally formed with the single piece of material, and.

16. The pump assembly of claim 5, further comprising a third connecting rod coupled to the second offset rod segment and to a fifth diaphragm and a sixth diaphragm, the third connecting rod configured to reciprocate along a third connecting rod axis that is parallel to the first connecting rod axis in response to rotation of the crankshaft to move the fifth diaphragm between an intake position and a compression position to pump the fluid flow drawn into the interior volume of the main housing through the fluid outlet and to move the sixth diaphragm between an intake position and a compression position to pump the fluid flow drawn into the interior volume of the main housing through the fluid outlet out of phase with the fifth diaphragm, wherein the third connecting rod axis is offset from the second connecting rod axis in a direction along the drive shaft axis; and a fourth connecting rod coupled to the second offset rod segment and to a seventh diaphragm and an eighth diaphragm, the fourth connecting rod configured to reciprocate along a fourth connecting rod axis that is parallel to the second connecting rod axis in response to rotation of the crankshaft to move the seventh diaphragm between an intake position and a compression position to pump the fluid flow drawn into the interior volume of the main housing through the fluid outlet and to move the eighth diaphragm between an intake position and a compression position to pump the fluid flow drawn into the interior volume of the main housing through the fluid outlet out of phase with the seventh diaphragm, wherein the fourth connecting rod axis is offset from the third connecting rod axis in a direction along the drive shaft axis wherein the fifth diaphragm is positioned along the first plane of the main housing, the sixth diaphragm is positioned along the second plane of the main housing, the seventh diaphragm is positioned along the third plane of the main housing, and the eighth diaphragm is positioned along the fourth plane of the main housing, such that the sixth diaphragm is orthogonal to seventh diaphragm and the sixth diaphragm is orthogonal to the eight diaphragm, wherein each of the fifth, sixth, seventh, and eighth diaphragms is integrally formed with the single piece of material of the diaphragm assembly and each of the fifth, sixth, seventh, and eighth diaphragms has an associated air intake valve and an associated air outlet valve each integrally formed with the single piece of material, wherein each of the fifth, sixth, seventh, and eighth diaphragms is associated with an aperture provided in the main housing, wherein each of the upper and lower covers includes a plurality of recesses each aligned with a respective aperture in the main housing that is associated with each of the fifth, sixth, seventh, and eighth diaphragms, wherein each pair of aligned recesses and each of the associated fifth, sixth, seventh, and eighth diaphragms defines an air chamber therebetween, wherein each air chamber for the fifth, sixth, seventh, and eighth diaphragms is in fluid communication with a respective air outlet valve, wherein the air outlet valve for the air chamber for the fifth diaphragm and the air outlet for the air chamber for the seventh diaphragm are each in fluid communication with the first air outlet passageway recessed into the first and third planes of the exterior surface of the main housing to provide fluid communication to the fluid outlet from the air chambers for the fifth and seventh diaphragms that are orthogonally positioned relative to each other, wherein the air outlet valve for the air chamber of the sixth diaphragm and the air outlet valve for the air chamber for the eighth diaphragm are each in fluid communication with the second air outlet passageway recessed into the second and fourth planes of the exterior surface of the main housing to provide fluid communication to the fluid outlet from the air chambers for the sixth and eighth diaphragms that are orthogonally positioned relative to each other.

17. A pump assembly comprising:

a housing including a main housing, an upper cover, a lower cover, a fluid outlet and an interior volume open to the surrounding environment through open ends of the housing, wherein a fluid flow is drawn into the interior volume of the main housing through the open ends of the main housing;

a motor supported by the main housing, the motor including a drive shaft rotatable about a drive shaft axis;

a crankshaft coupled to the drive shaft for rotation by the drive shaft;

a diaphragm assembly supported by the main housing and including a first, second, third, and fourth diaphragm, wherein the main housing and diaphragm assembly are configured such that each of the first, second, third, and fourth diaphragms is fluidly connected with the interior volume of the main housing to receive the fluid flow drawn into the interior volume of the main housing;

a first connecting rod coupled to the crankshaft and to the first diaphragm and the second diaphragm, the first connecting rod configured to reciprocate along a first connecting rod axis in response to rotation of the crankshaft to move the first diaphragm between an intake position and a compression position to pump the fluid flow drawn into the interior volume of the main housing through the fluid outlet and to move the second diaphragm between an intake position and a compression position to pump the fluid flow drawn into the interior volume of the main housing through the fluid outlet out of phase with the first diaphragm; and a second connecting rod coupled to the crankshaft and to the third diaphragm and the fourth diaphragm, the second connecting rod configured to reciprocate along a second connecting rod axis that is not parallel to the first connecting rod axis in response to rotation of the crankshaft to move the third diaphragm between an intake position and a compression position to pump the fluid flow drawn into the interior volume of the main housing through the fluid outlet and to move the fourth diaphragm between an intake position and a compression position to pump the fluid flow drawn into the interior volume of the main housing through the fluid outlet out of phase with the third diaphragm, wherein the second connecting rod axis is offset from the first connecting rod axis in a direction along the drive shaft axis, wherein the first diaphragm is positioned along a first plane of the main housing, the second diaphragm is positioned along a second plane of the main housing spaced apart from and parallel to the first plane, the third diaphragm is positioned along a third plane of the main housing orthogonal to the first and second planes, and the fourth diaphragm is positioned along a fourth plane of the main housing spaced apart from and parallel to the third plane, wherein the first, second, third, and fourth diaphragms define a diaphragm assembly positioned between an exterior surface of the main housing and an interior surface of each of the upper and lower covers, the diaphragm assembly further including a plurality of air intake valves and a plurality of air outlet valves, wherein each diaphragm of the diaphragm assembly is associated with an aperture provided in the main housing, wherein the diaphragm assembly has a main body integrally formed as a single piece of material, wherein each diaphragm of the diaphragm assembly, each air intake valve of the plurality of air intake valves, and each air outlet valve of the plurality of air outlet valves is integrally formed with the single piece of material, wherein each of the first, second, third, and fourth diaphragms is associated with a respective aperture provided in the main housing, wherein each of the upper and lower covers includes a plurality of recesses each aligned with a respective aperture in the main housing and an associated diaphragm, wherein each pair of aligned recesses and diaphragms defines an air chamber therebetween, wherein each air chamber is in fluid communication with a respective air intake valve of the plurality of air intake valves, each air intake valve is configured to be in fluid communication with a corresponding air intake passageway formed in the main housing, and wherein each air chamber is in fluid communication with a respective air outlet valve of the plurality of air outlet valves, each air outlet valve is configured to be in fluid communication with corresponding air outlet passageway recessed into the exterior surface of the main housing beneath the diaphragm assembly such that the diaphragm assembly forms a portion of an outer lateral wall of each air outlet passageway apart from each air outlet valve in fluid communication with the respective air outlet passageway, and wherein each of the upper and lower covers includes a plurality of openings, wherein each opening is positioned over and in fluid communication with either a respective air intake valve of the plurality of air intake valves or a respective air outlet valve of the plurality of air outlet valves, wherein each opening is configured to direct airflow either into or out of a respective air chamber in an airflow path parallel to a direction of the reciprocation of each of the respective first, second, third, and fourth diaphragms between the intake position and the compression position.

18. The pump assembly of claim 17, wherein each air intake passageway defines an aperture extending through the main housing.

19. The pump assembly of claim 18, wherein the air outlet valve for the air chamber of the first diaphragm and the air outlet valve for the air chamber of the third diaphragm are each in fluid communication with a first air outlet passageway recessed into the first and third planes of the exterior surface of the main housing between the diaphragm assembly and the main housing to provide an air outlet flow path beneath the diaphragm assembly, wherein the air outlet valve for the air chamber of the second diaphragm and the air outlet valve for the air chamber of the fourth diaphragm are each in fluid communication with a second air outlet passageway recessed into the second and fourth planes of the exterior surface of the main housing between the diaphragm assembly and the main housing to provide an air outlet flow path beneath the diaphragm assembly, wherein each of the first and second air outlet passageways is configured to provide fluid communication to the fluid outlet from two air chambers orthogonally positioned relative to each other.

20. A pump assembly comprising:

a housing including a main housing, an upper cover, a lower cover, a fluid outlet and an interior volume open to the surrounding environment through open ends of the main housing, wherein a fluid flow is drawn into the interior volume of the main housing through the open ends of the main housing;

a motor supported by the main housing, the motor including a drive shaft rotatable about a drive shaft axis;

a crankshaft coupled to the drive shaft for rotation by the drive shaft;

a diaphragm assembly supported by the housing and including a first, second, third, and fourth diaphragm, wherein the main housing and diaphragm assembly are configured such that each of the first, second, third, and fourth diaphragms is fluidly connected with the interior volume of the main housing to receive the fluid flow drawn into the interior volume of the main housing;

a first connecting rod coupled to the crankshaft and to the first diaphragm and the second diaphragm, the first connecting rod configured to reciprocate along a first connecting rod axis in response to rotation of the crankshaft to move the first diaphragm between an intake position and a compression position to pump the fluid flow drawn into the interior volume of the main housing through the fluid outlet and to move the second diaphragm between an intake position and a compression position to pump the fluid flow drawn into the interior volume of the main housing through the fluid outlet out of phase with the first diaphragm; and a second connecting rod coupled to the crankshaft and to the third diaphragm and the fourth diaphragm, the second connecting rod configured to reciprocate along a second connecting rod axis that is not parallel to the first connecting rod axis in response to rotation of the crankshaft to move the third diaphragm between an intake position and a compression position to pump the fluid flow drawn into the interior volume of the main housing through the fluid outlet and to move the fourth diaphragm between an intake position and a compression position to pump the fluid flow drawn into the interior volume of the main housing through the fluid outlet out of phase with the third diaphragm, wherein the second connecting rod axis is offset from the first connecting rod axis in a direction along the drive shaft axis, wherein the first diaphragm is positioned along a first plane of the main housing, the second diaphragm is positioned along a second plane of the main housing spaced apart from and parallel to the first plane, the third diaphragm is positioned along a third plane of the main housing orthogonal to the first and second planes, and the fourth diaphragm is positioned along a fourth plane of the main housing spaced apart from and parallel to the third plane, wherein the first, second, third, and fourth diaphragms define a diaphragm assembly positioned between an exterior surface of the main housing and an interior surface of each of the upper and lower covers, the diaphragm assembly further including a plurality of air intake valves and a plurality of air outlet valves, wherein each diaphragm of the diaphragm assembly is associated with an aperture provided in the main housing, wherein the diaphragm assembly has a main body integrally formed as a single piece of material, wherein each diaphragm of the diaphragm assembly, each air intake valve of the plurality of air intake valves, and each air outlet valve of the plurality of air outlet valves is integrally formed with the single piece of material, wherein each of the upper and lower covers includes a plurality of recesses each aligned with a respective aperture in the main housing and an associated diaphragm, wherein each pair of aligned recesses and diaphragms defines an air chamber therebetween, wherein each air chamber is in fluid communication with a respective air intake valve of the plurality of air intake valves, each air intake valve configured to be in fluid communication with a corresponding air intake passageway formed in the main housing, and wherein each air chamber is in fluid communication with a respective air outlet valve of the plurality of air outlet valves, each air outlet valve is configured to be in fluid communication with a corresponding air outlet passageway recessed into the exterior surface of the main housing beneath the diaphragm assembly, wherein the main housing, diaphragm assembly, and upper and lower covers are configured such that the diaphragm assembly forms a portion of an outer lateral wall of each air outlet passageway apart from each air outlet valve in fluid communication with the respective air outlet passageway.

* * * * *